US009505229B2

(12) United States Patent
Kaneoya

(10) Patent No.: US 9,505,229 B2
(45) Date of Patent: Nov. 29, 2016

(54) APPARATUS FOR FORMING IMAGES

(71) Applicant: Daisuke Kaneoya, Yamanashi-ken (JP)

(72) Inventor: Daisuke Kaneoya, Yamanashi-ken (JP)

(73) Assignee: NISCA CORPORATION, Minamikoma-Gun, Yamanashi-Ken (JP)

( * ) Notice: Subject to any disclaimer, the term of this patent is extended or adjusted under 35 U.S.C. 154(b) by 0 days.

(21) Appl. No.: 15/086,967

(22) Filed: Mar. 31, 2016

(65) Prior Publication Data

US 2016/0288530 A1 Oct. 6, 2016

(30) Foreign Application Priority Data

Mar. 31, 2015 (JP) ..... 2015-071794
Mar. 31, 2015 (JP) ..... 2015-071795

(51) Int. Cl.
*B41J 2/325* (2006.01)

(52) U.S. Cl.
CPC ..... *B41J 2/325* (2013.01)

(58) Field of Classification Search
CPC B41F 16/00; B41F 16/0006; B41F 16/0026; B41F 16/0033; B41J 2/315; B41J 2/32; B41J 2/325
See application file for complete search history.

(56) References Cited

U.S. PATENT DOCUMENTS 6,227,730 B1 * 5/2001 Yorozu ..... B41J 2/325 400/120.01
2005/0041087 A1 * 2/2005 Ueda ..... B41J 2/32 347/171
2010/0118101 A1 * 5/2010 Yamakuni ..... B41J 2/325 347/188

FOREIGN PATENT DOCUMENTS

JP 2002-361917 A 12/2002
JP 2004-050775 A 2/2004

* cited by examiner

*Primary Examiner* — Kristal Feggins
(74) *Attorney, Agent, or Firm* — Manabu Kanesaka

(57) ABSTRACT

To prevent reduction in printing quality, a printer includes an image formation section having a thermal head with a plurality of heating elements and transporting an ink ribbon and a transfer film at the same velocity to form an image on the transfer film, and a control section controlling the image formation section. The control section controls the image formation section to form a printing image on the transfer film according to input printing information and form a dummy image wider than the printing image on the width-direction opposite sides at the back thereof in the transport direction. On the ink ribbon, a wrinkle, which occurs in the rear end corner portion in the transport direction of a printing region corresponding to the printing image, is stopped by a sag caused by that the ink is removed in a dummy printing region Rd corresponding to the dummy image.

9 Claims, 21 Drawing Sheets

APPARATUS FOR FORMING IMAGES

TECHNICAL FIELD

The present invention relates to an image formation apparatus, and more particularly, to an image formation apparatus for forming an image on a medium using an ink ribbon.

BACKGROUND ART

Conventionally, such an image formation apparatus has been known widely that forms an image on a transfer medium such as a transfer film and an image carrying body or a recording medium such as a card and sheet. This type of image formation apparatus uses an indirect printing scheme for forming an image (mirror image) on a transfer medium using an ink ribbon, and next transferring the image formed on the transfer medium to a recording medium, or a direct printing scheme for forming an image directly on a recording medium using an ink ribbon.

Such an image formation apparatus is generally provided with an image formation section having a thermal head with a plurality of heating elements arranged, and platen (for example, platen roller) disposed opposite the thermal head, transports an ink ribbon and a medium (transfer medium in the indirect printing scheme, recording medium in the direct printing scheme) at the same velocity while supporting the back side (opposite surface side to the image formation surface) of the medium by the platen, selectively operates (heat-controls) the heating elements of the thermal head brought into press-contact with the ink ribbon, and thereby forms an image.

Further, in such an image formation apparatus, there is the case where printing is performed with single-color ink (for example, Bk (Black) ink), and there are many cases that color printing for generating a color image is performed by superimposing respective images with inks of a plurality of colors. In the case of color printing, printing is performed by superimposing images for each of inks of a plurality of colors (for example, inks of YMC) on a medium, according to input printing data or printing data (for example, printing data for each of Y (Yellow), M (Magenta) and C (Cyan)) obtained by converting input image data. Therefore, in color printing is used an ink ribbon with ink panels of a plurality of colors and a Bk (Black) ink panel as necessary repeated in a face sequential manner. In addition, for example, the Bk ink is used in the case of sharpening the contour, or in the case of forming an image of logo, character and the like.

In addition, in the image formation apparatus using the ink ribbon, a phenomenon for degrading printing quality on the medium arises by effect of a wrinkle occurring in the ink ribbon. This wrinkle occurs due to a level difference in a rear end corner portion in the ink ribbon transport direction of a printing region of the ink ribbon. Usually, in the case where tension on the ink ribbon is uniformly applied, any wrinkle does not occur even when such a level difference arises. However, when the tension balance is lost due to some cause, the wrinkle caused by the level difference occurs easily.

The phenomenon will be described more specifically. As shown in FIGS. 17A and 17B, for example, wrinkles Wr of an ink ribbon 41 are caused by a level difference due to ink removal in rear end corner portions in the transport direction of a printing region Rt of a Y ink panel of the ink ribbon 41 in image formation, and spread to a printing region Rt of a next M ink panel. Therefore, when an image of M ink is formed on the medium using the printing region Rt of the M ink panel with the wrinkles Wr formed, by effects of the wrinkles Wr extended from the Y ink panel, on the medium occurs pixel removal (a part of pixels are not printed) and pixel hopping (a part of pixels are printed in a position different from a position indicated by printing data.) In color printing, since printing is performed by superimposing images for each of inks of a plurality of colors, when the pixel removal and/or pixel hopping occurs, printing quality degrades.

On the other hand, conventionally, on the transfer medium, known are techniques (for example, see Patent Document 1) for arranging a dummy image so as to enclose a printing image, and techniques (for example, see Patent Document 2) for arranging dummy images on the opposite outer sides of the printing image.

PRIOR ART DOCUMENT

Patent Document

[Patent Document 1] Japanese Patent Application Publication No. 2002-361917 (see FIG. 4)

[Patent Document 2] Japanese Patent Application Publication No. 2004-050775 (see FIG. 9)

DISCLOSURE OF INVENTION

Problems to be Solved by the Invention

In addition, in the techniques in Patent Document 1, with attention directed toward the ink ribbon while substituting a card as a printing object, since a dummy printing region (region of the ink ribbon 41 corresponding to the dummy image of the medium, see reference numeral Rd of FIG. 18A) exists also on the upstream side of a printing region (region of the ink ribbon 41 corresponding to the printing image of the medium, see reference numeral Rt of FIG. 18A), wrinkles (see reference numeral Wr of FIG. 18A) caused by the level difference occur and spread to the printing region, and the printing quality thereby degrades. Further, in the techniques in Patent Document 2, with attention directed toward the ink ribbon, since dummy printing regions (see reference numeral Rd of FIG. 18B) are disposed only on the opposite sides of printing regions (see reference numeral Rt of FIG. 18B), there is no effect of stemming wrinkles generated in the preceding panel (Y ink panel in FIG. 18B) in the transport direction, wrinkles (see reference numeral Wr of FIG. 18B) caused by the level difference spread to the next panel (M ink panel in FIG. 18B), and as in the case shown in FIGS. 17A and 17B, the printing quality degrades.

In view of the aforementioned matter, it is an object of the present invention to provide an image formation apparatus capable of preventing reduction in printing quality caused by a wrinkle of an ink ribbon.

Means for Solving the Problem

In order to attain the above-mentioned object, in the present invention, in an image formation apparatus for forming an image on a medium using an ink ribbon, the apparatus is provided with an image formation section that includes a thermal head with a plurality of heating elements arranged and that transports the ink ribbon and the medium at the same velocity to form an image on the medium, and a control section that controls the image formation section, where the control section controls the image formation section so as to form a printing image on the medium according to input printing information, and operate the heating elements on the ink ribbon to form a dummy image at the back of the printing image in a transport direction of the medium, and the dummy image is wider than the printing image on opposite sides in a width direction of the medium crossing the transport direction of the medium.

In the invention, it is preferable that the control section controls the image formation section so as to form the printing image and the dummy image by a series of operation. Further, the control section may control the image formation section so that gradation values of pixels inside a region of the dummy image are the same. The ink ribbon includes panels of a plurality of colors of dye ink panel and pigment ink panel, and the control section may control the image formation section so as to form the dummy image by operating the heating elements on at least the pigment ink panel among ink panels. Alternatively, the ink ribbon is formed by repeating ink panels of a plurality of colors and a Bk (Black) ink panel as necessary in a face sequential manner, and the control section may control the image formation section so as to form the printing image and the dummy image by operating the heating elements on each of the ink panels. Further, the invention is applicable to both of image formation apparatuses of indirect and direct printing schemes, the medium is a film-shaped intermediate transfer medium, and the apparatus may further be provided with a transfer section that transfers a printing image formed on the intermediate transfer medium to a printing medium. Alternatively, the medium is a card-shaped recording medium, the image formation section further includes a platen roller disposed opposite the thermal head, a circumferential length of the platen roller is longer than a length of the recording medium, and the platen roller may include a region that receives ink of the ink ribbon in forming the dummy image in a part of the circumferential surface.

Advantageous Effect of the Invention

According to the present invention, since the image formation section is controlled so that the ink ribbon and the medium are transported at the same velocity, and that the dummy image wider than the printing image on the width-direction opposite sides is formed at the back of the printing image in the medium transport direction, on the ink ribbon, it is possible to relax the effect of the wrinkle, which occurs in the rear end corner portion in the transport direction of the printing region corresponding to the printing image of the medium, to stem by a sag caused by that the ink is removed in the dummy printing region of the ink ribbon corresponding to the dummy image, and since the dummy printing region is wider than the printing region on the width-direction opposite sides, the wrinkle itself occurring in the rear end corner portion of the dummy printing region in the transport direction does not affect the next printing region. It is thereby possible to obtain the effect of enabling reduction in printing quality caused by the wrinkle of the ink ribbon to be prevented.

BRIEF DESCRIPTION OF DRAWINGS

FIG. 15A illustrates a state in which an image is formed on the image formation surface side of a card with the back side of the card supported on a first circumferential area of the platen roller, and FIG. 15B illustrates a state in which ink of the ink ribbon is received in forming a dummy image in a second circumferential area of the platen roller;

FIG. 16A shows the example shown in the Embodiment, FIG. 16B shows Modification 1, FIG. 16C shows Modification 2, FIG. 16D shows Modification 3, FIG. 16E shows Modification 4, and FIG. 16F shows Modification 5;

FIG. 17A shows wrinkles arising in the ink ribbon immediately after forming an image on the transfer film using the Y ink panel that is the first panel of the ink ribbon, and FIG. 17B shows a cross section along the line (B)-(B) of FIG. 17A;

FIG. 18A shows the case of applying techniques of Patent Document 1, and FIG. 18B shows the case of applying techniques of Patent Document 2;

FIG. 20A shows a difference in the length of one frame, and FIG. 20B shows a difference in the diameter of a new ink ribbon wound around a supply spool;

FIG. 21A shows the case of Embodiment 1, and FIG. 21B shows the case of Embodiment 2; FIG. 22A shows the Example in Embodiment 2, FIG. 22B shows Modification 1, FIG. 22C shows Modification 2, FIG. 22D shows Modification 3, FIG. 22E shows Modification 4, and FIG. 22F shows Modification 5.

BEST MODE FOR CARRYING OUT THE INVENTION

Embodiments will be described below where the present invention is applied to a printer for printing and recording text and image on a card, while performing magnetic or electric information recording on the card.

<System Configuration>

Figure 1:
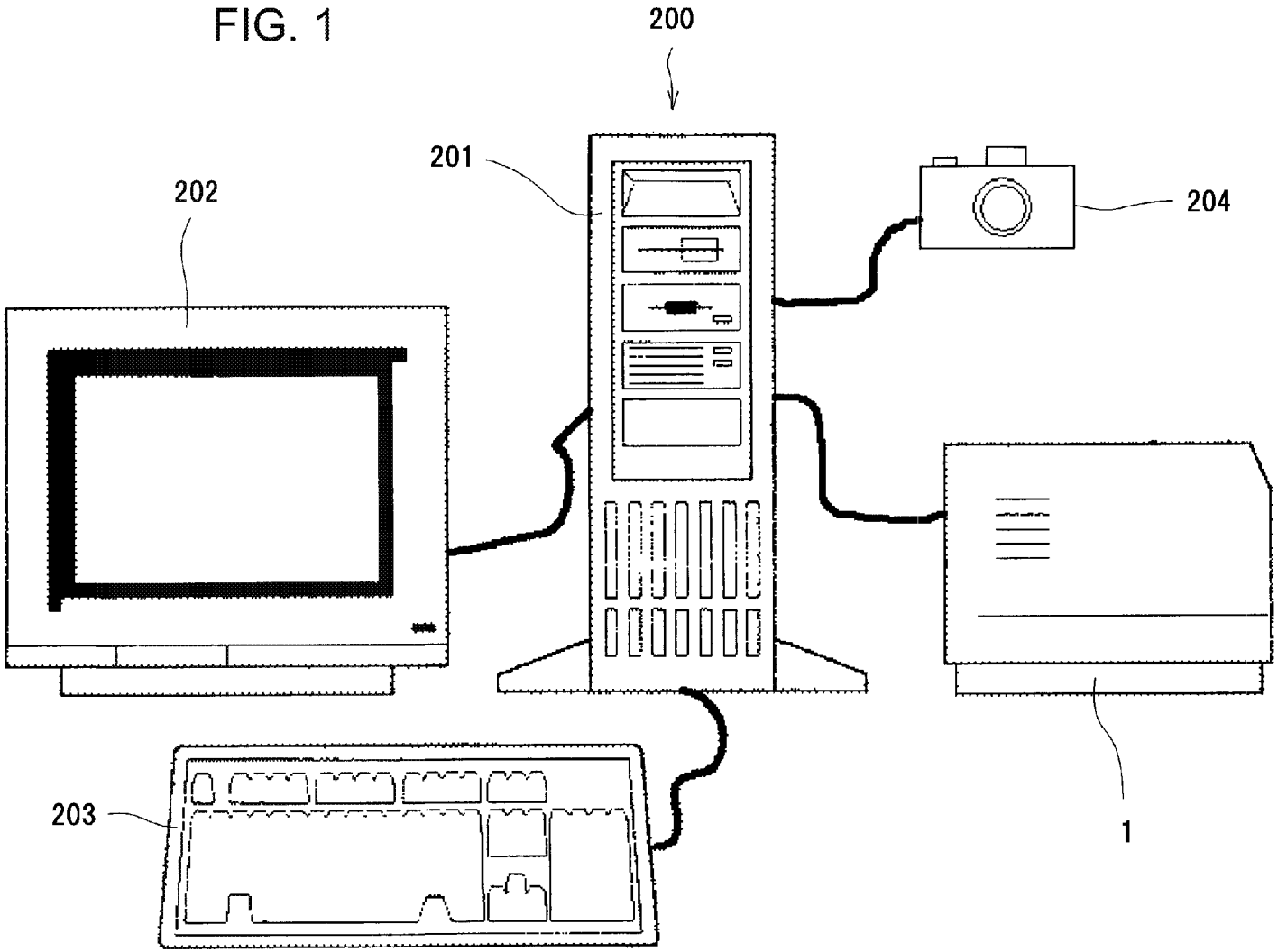
FIG. 1 is an external view of a printing system including a printer of an Embodiment to which the present invention is applicable.
Figure 12:
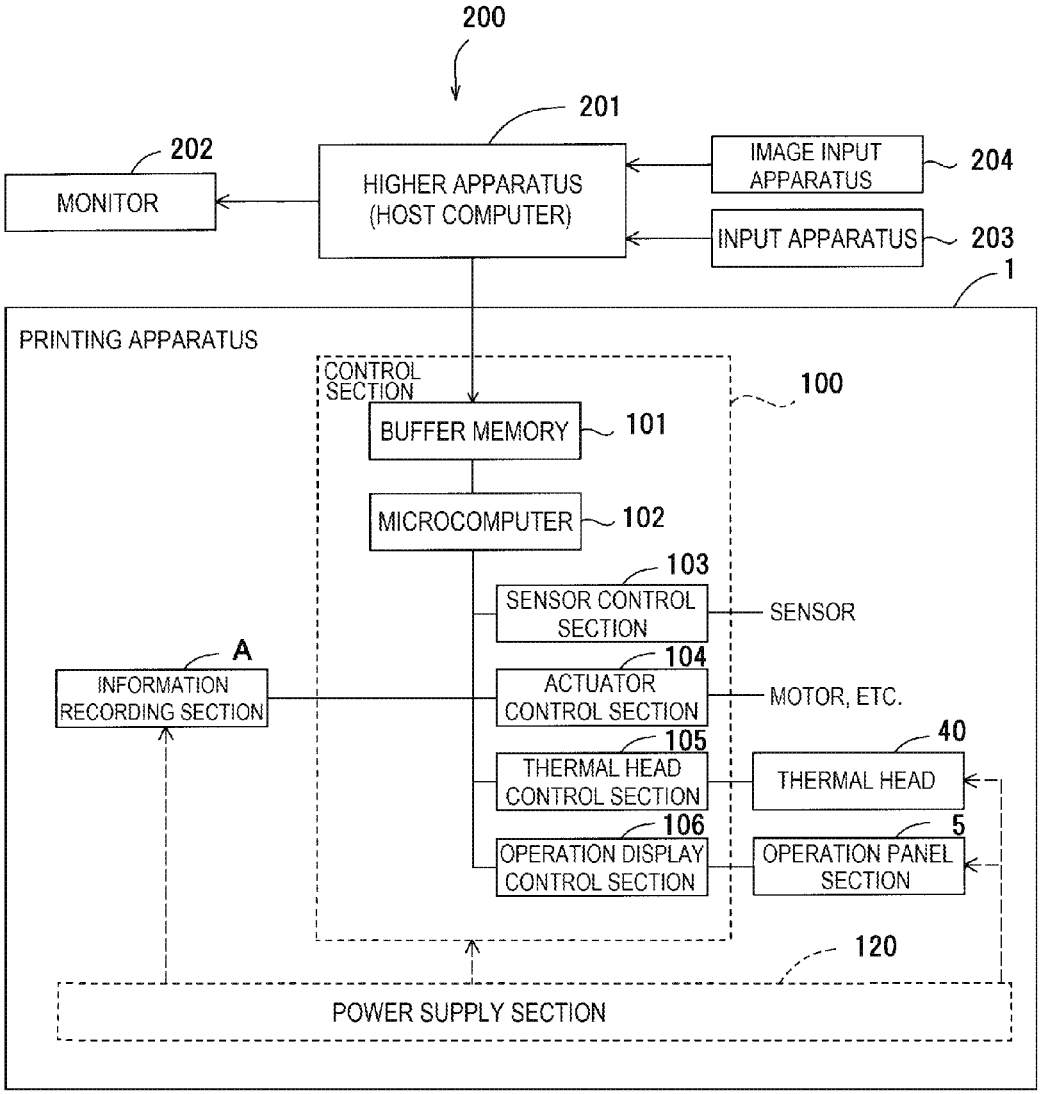
FIG. 12 is a block diagram illustrating a schematic configuration of a control section in the printer of the Embodiment.

As shown in FIGS. 1 and 12, a printer 1 of this Embodiment constitutes a part of a printing system 200. In other words, the printing system 200 is broadly comprised of a higher apparatus 201 (for example, host computer such as a personal computer), and the printer 1.

The printer 1 is connected to the higher apparatus 201 via an interface with the figure omitted, and the higher apparatus 201 is capable of transmitting printing data (or image data), magnetic or electric recording data and the like to the printer 1 to indicate recording operation and the like. In addition, the printer 1 has an operation panel section (operation display section) 5 (see FIG. 12), and as well as recording operation indication from the higher apparatus 201, recording operation is also capable of being indicated from the operation panel section 5.

The higher apparatus 201 is connected to an image input apparatus 204 such as a digital camera and scanner, an input apparatus 203 such as a keyboard and mouse to input commands and data to the higher apparatus 201, and a monitor 202 such as a liquid crystal display to display data and the like generated in the higher apparatus 201.

<Printer>

Figure 2:
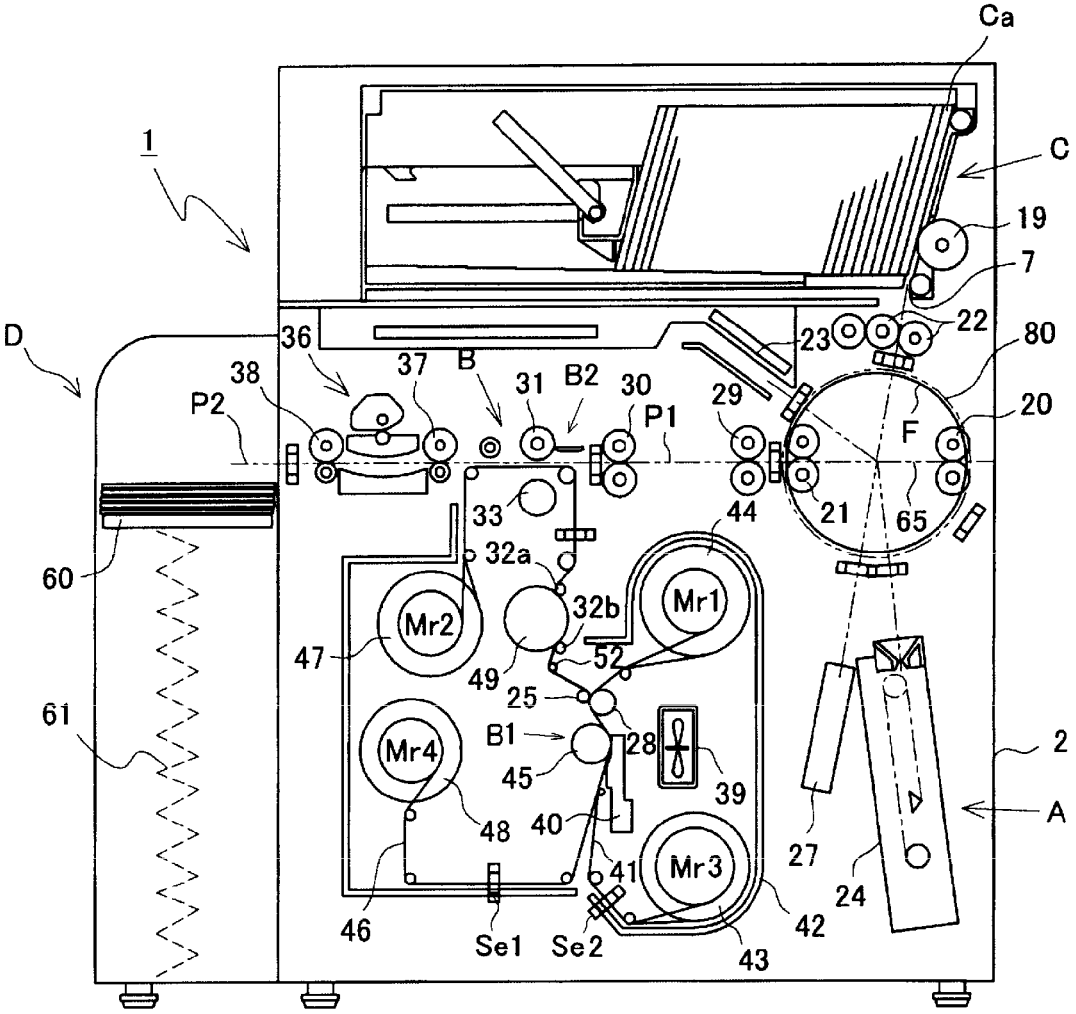
FIG. 2 is a schematic configuration view of the printer of the Embodiment.

As shown in FIG. 2, the printer 1 has a housing 2, and in the housing 2 are provided an information recording section A, printing section B, media storage section C, storage section D and rotating unit F.

(Information Recording Section)

The information recording section A is comprised of a magnetic recording section 24, non-contact type IC recording section 23, and contact type IC recording section 27.

(Media Storage Section)

The media storage section C stores a plurality of cards aligned in a standing posture, is provided at its front end with a separation opening 7, feeds and supplies sequentially starting with the card in the front row with a pickup roller 19.

(Rotating Unit)

The fed blank card Ca is sent to a reverse unit F with carry-in rollers 22. The reverse unit F is comprised of a rotating frame 80 bearing-supported by the housing 2 to be turnable, and two roller pairs 20, 21 supported on the frame. Then, the roller pairs 20, 21 are axially supported by the rotating frame 80 to be rotatable.

In the outer region of the rotating reverse unit F are disposed the above-mentioned magnetic recording section 24, non-contact type IC recording section 23, and contact type IC recording section 27. Then, the roller pairs 20, 21 form a medium transport path 65 for transporting the card Ca toward one of the information recording sections 23, 24 and 27, and data is magnetically or electrically written on the card Ca in the recording sections.

(Printing Section)

The printing section B is to form an image such as a photograph of face and text data on the frontside and backside of the card Ca, and a medium transport path P1 for carrying the card Ca is provided on an extension of the medium transport path 65. Further, in the medium transport path P1 are disposed transport rollers 29, 30 that transport the card Ca, and the rollers are coupled to a transport motor not shown.

The printing section B has a film-shaped medium transport mechanism, and is provided with an image formation section B1 that forms an image, with a thermal head 40, on a transfer film 46 transported with the transport mechanism, and a transfer section B2 that subsequently transfers the image formed on the transfer film 46 to the surface of the card Ca on the medium transport path P1 with a heat roller 33.

On the downstream side of the printing section B is provided a medium transport path P2 for carrying the printed card Ca to a storage stacker 60. In the medium transport path P2 are disposed transport rollers 37, 38 that transport the card Ca, and the rollers are coupled to a transport motor not shown.

A decurl mechanism 36 is disposed in between the transport roller 37 and the transport roller 38, presses the card center portion held between the transport rollers 37, 38, and thereby corrects a curl generated by thermal transfer with the heat roller 33. Therefore, the decurl mechanism 36 is configured to be able to shift to positions in the vertical direction as viewed in FIG. 2 by an up-and-down mechanism including a cam not shown.

(Storage Section)

The storage section D is configured to store cards Ca sent from the printing section Bin the storage stacker 60. The storage stacker 60 is configured to shift downward in FIG. 2 with an up-and-down mechanism 61

(Details of the Printing Section)

Next, the printing section B of the printer 1 as described above will be further described specifically.

The transfer film 46 has the shape of a band having a width slightly larger than the width direction of the card Ca, and is formed by layering, from above, an ink reception layer that receives ink of an ink ribbon 41, a transparent protective layer that protects the surface of the ink reception layer, a peeling layer to promote integral peeling of the ink reception layer and protective layer by heat, and a substrate (base film) in this order.

The transfer film 46 is wound up or fed by a wind-up roll or feed roll that rotates inside a transfer film cassette by driving of motor Mr2 or Mr4, respectively. In other words, in the transfer film cassette, a wind-up spool 47 is disposed in the center of the wind-up roll, a supply spool 48 is disposed in the center of the feed roll, a rotation drive force of the motor Mr2 is transferred to the wind-up spool 47 via a gear not shown, and a rotation drive force of the motor Mr4 is transferred to the supply spool 48 via a gear not shown.

A film transport roller 49 is a main drive roller to carry the transfer film 46, and by controlling driving of the roller 49, transport amount and transport halt position of the transfer film 46 are determined. The film transport roller 49 is coupled to a stepping motor not shown. Accordingly, by monitoring the number of pulses output to the stepping motor not shown, controlled are a printing start position in the transfer film 46 with the thermal head 40 in the image formation section B1, and a transfer position of the transfer film 46 to the card Ca in the transfer section B2. In addition, the motors Mr2 and Mr4 are driven also in driving the film transport roller 49, are to wind up the transfer film 46 fed from one of the wind-up spool 47 and supply spool 48 with the other one, and are not driven as main transport of the transfer film 46. In addition, forward-backward rotatable DC motors are used for the motors Mr2 and Mr4.

Pinch rollers 32*a* and 32*b* are disposed on the periphery of the film transport roller 49. Although not shown in FIG. 2, the pinch rollers 32*a* and 32*b* are configured to be movable to move and retract with respect to the film transport roller 49, and in a state in the figure, the rollers move to the film transport roller 49 to come into press-contact, and thereby wind the transfer film 46 around the film transport roller 49. By this means, the transfer film 46 undergoes accurate transport by a distance corresponding to the number of revolutions of the film transport roller 49.

The ink ribbon 41 is held in an ink ribbon cassette 42, and is stored in the cassette 42 in a state in which the ribbon is laid between a supply spool 43 for supplying the ink ribbon 41 and a wind-up spool 44 for winding up the ink ribbon 41, the wind-up spool 44 rotates by a drive force of a motor Mr1, and the supply spool 43 rotates by a drive force of a motor Mr3. Forward-backward rotatable DC motors are used for the motors Mr1 and Mr3.

The ink ribbon 41 is configured by repeating ink panels of Y (Yellow), M (Magenta), and C (Cyan) and a Bk (Black) ink panel in the longitudinal direction in a face sequential manner. In addition, in this Embodiment, dye ink is used in the YMC ink panel, and pigment ink is used in the Bk ink panel. Further, an empty mark indicative of a use limit of the ink ribbon 41 is attached to an end portion of the ink ribbon 41. "Se2" shown in FIG. 2 denotes a transmission sensor to detect the empty mark.

A platen roller 45 and thermal head 40 form the image formation section B1, and the thermal head 40 is disposed in a position opposed to the platen roller 45. The thermal head 40 has a plurality of heating elements lined in the main scanning direction, these heating elements are selectively heated and controlled by a head control IC (not shown) according to printing data, and an image is printed on the transfer film 46 via the ink ribbon 41. In addition, a cooling fan 39 is to cool the thermal head 40.

The ink ribbon 41 with which printing on the transfer film 46 is finished is peeled off from the transfer film 46 with a peeling roller 25 and peeling member 28. The peeling member 28 is fixed to the ink ribbon cassette 42, the peeling roller 25 comes into contact with the peeling member 28 in printing, and the roller 25 and member 28 nip the transfer film. 46 and ink ribbon 41 to peel. Then, the peeled ink ribbon 41 is wound around the wind-up spool 44 by the drive force of the motor Mr1, and the transfer film 46 is transported to the transfer section B2 having the platen roller 31 and heat roller 33 by the film transport roller 49.

In the transfer section B2, the transfer film 46 is nipped together with the card Ca by the heat roller 33 and platen roller 31, and the image on the transfer film 46 is transferred to the card surface. At this point, the transfer film 46 and the card Ca are transported at the same velocity. In addition, the heat roller 33 is attached to an up-and-down mechanism (not shown) so as to come into contact with and separate from the platen roller 31 via the transfer film 46.

Figure 3:
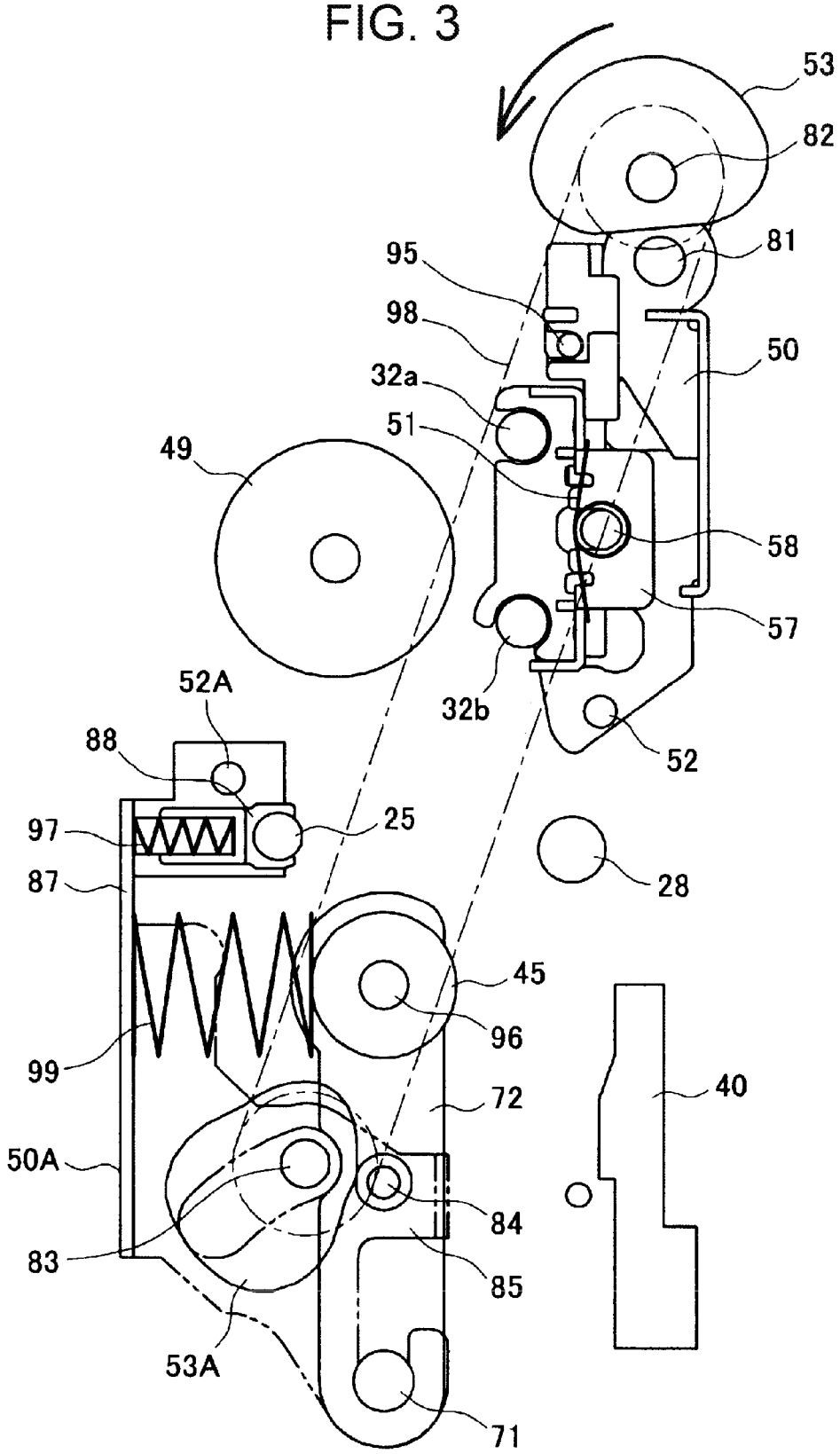
FIG. 3 is an explanatory view of a control state by a cam in a waiting position in which pinch rollers and film transport roller are separated from each other, and a platen roller and thermal head are separated from each other.
Figure 4:
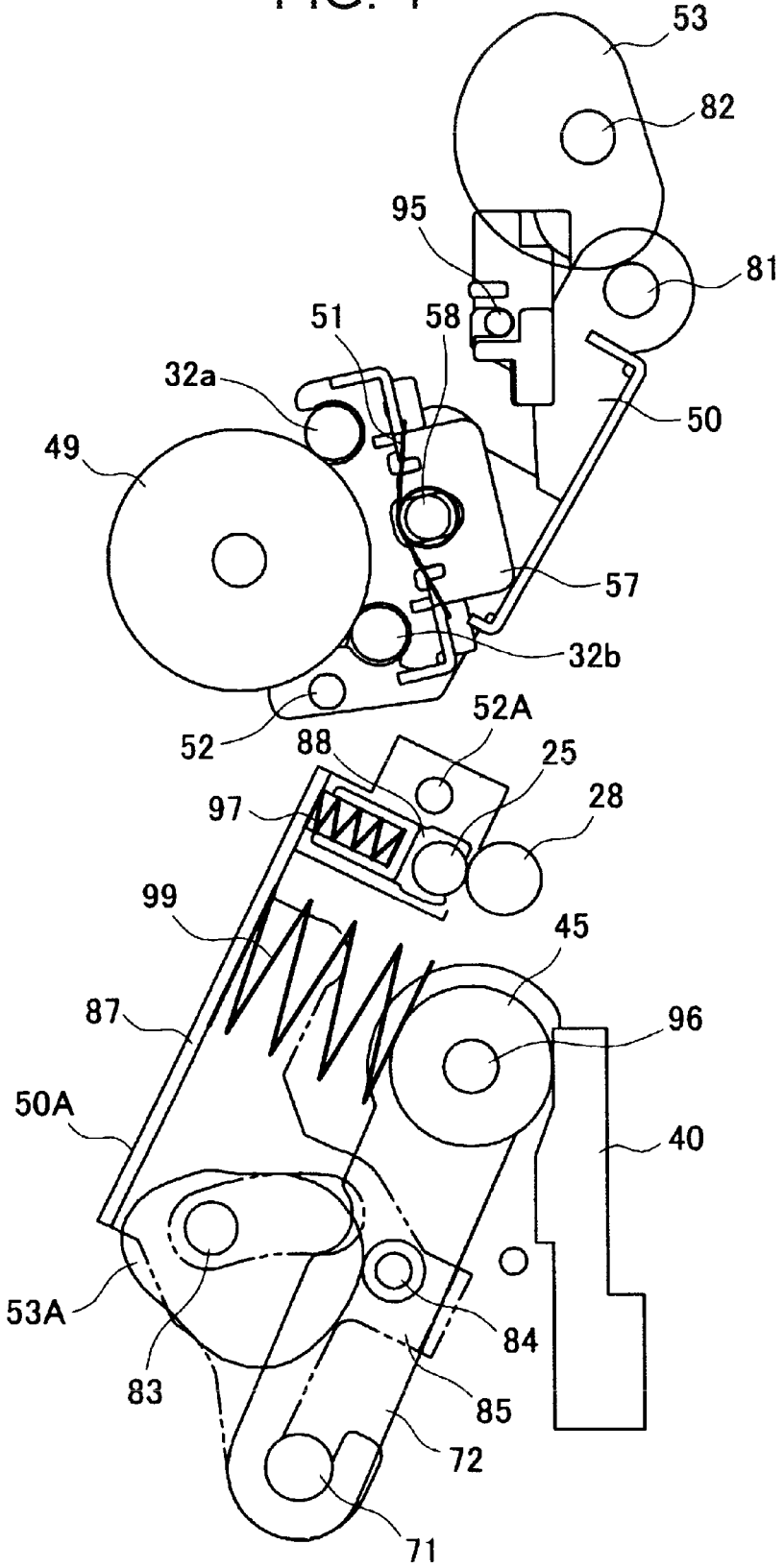
FIG. 4 is an explanatory view of a control state by the cam in a printing position in which the pinch rollers and film transport roller are brought into contact with each other, and the platen roller and thermal head are brought into contact with each other.
Figure 5:
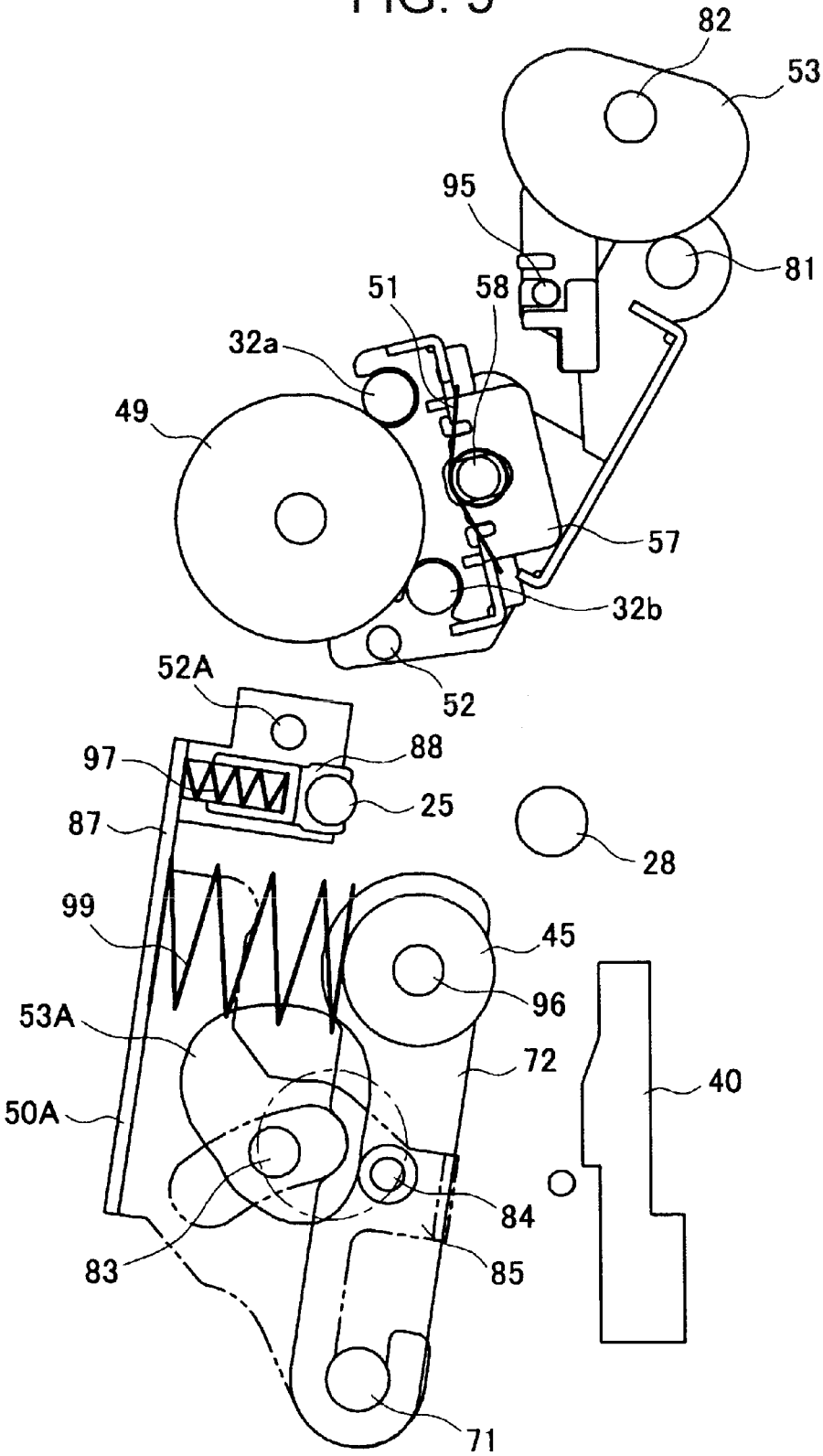
FIG. 5 is an explanatory view of a control state by the cam in a transport position in which the pinch rollers and film transport roller are brought into contact with each other, and the platen roller and thermal head are brought into contact with each other.
Figure 10:
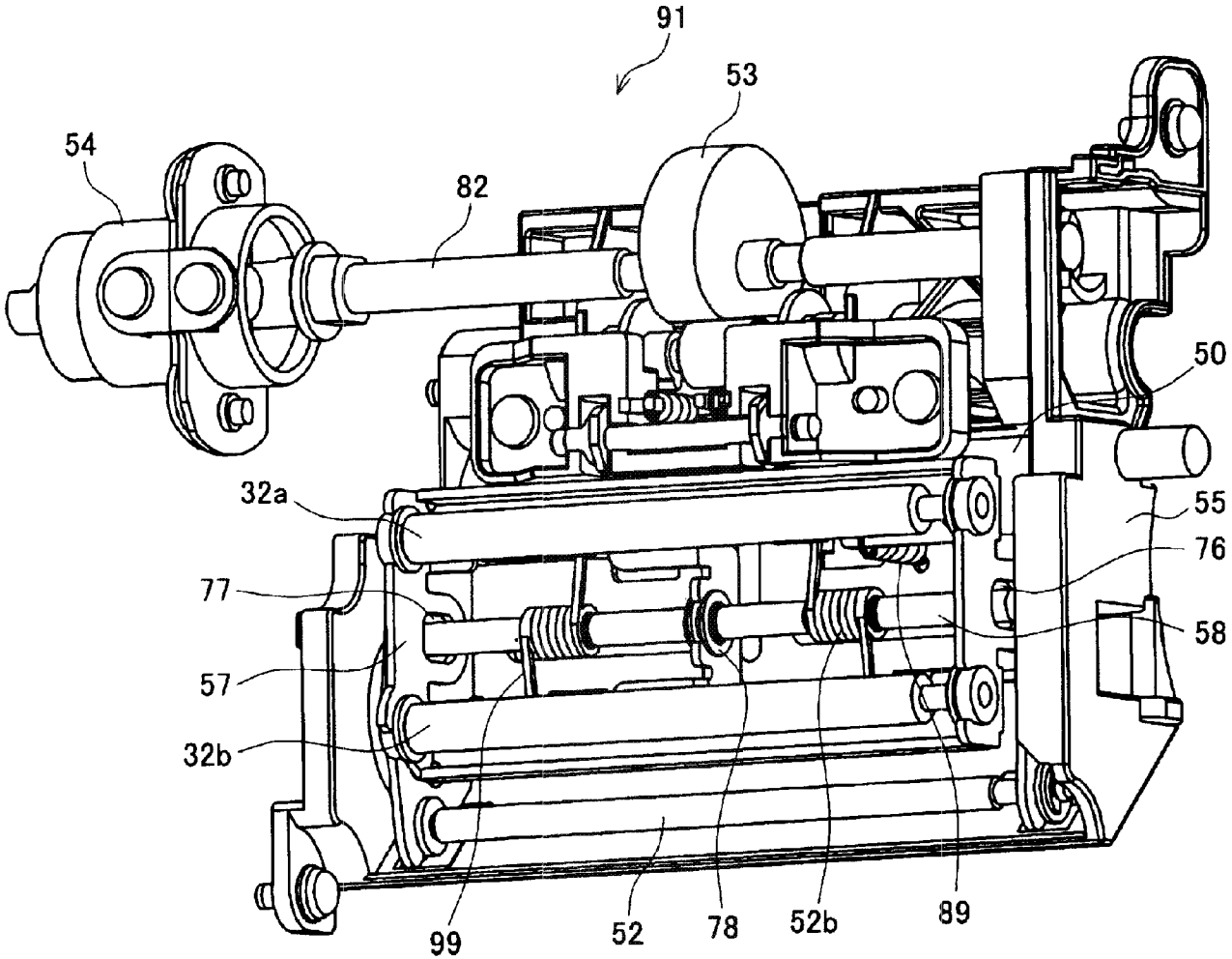
FIG. 10 is an external view showing a configuration of a second unit integrated to incorporate the pinch rollers and their peripheral parts into the printer.

The configuration of the image formation section B1 will specifically be described further together with its action. As shown in FIGS. 3 to 5, the pinch rollers 32*a*, 32*b* are respectively supported by an upper end portion and lower end portion of a pinch roller support member 57, and the pinch roller support member 57 is supported rotatably by a support shaft 58 penetrating the center portion of the member 57. As shown in FIG. 10, the support shaft 58 is laid at its opposite end portions between long holes 76, 77 formed in the pinch roller support member 57, and is at its middle portion fixed to a fix portion 78 of a bracket 50. Further, the long holes 76, 77 are provided with spaces in the horizontal direction and vertical direction with respect to the support shaft 58. By this means, it is made possible to adjust the pinch rollers 32*a*, 32*b* with respect to the film transport roller 49, described later.

Spring members 51 (51*a*, 51*b*) are mounted on the support shaft 58, and end portions on which the pinch rollers 32*a*, 32*b* are installed of the pinch roller support member 57 respectively contact the spring members 51, and are biased to the direction of the film transport roller 49 by the spring forces.

The bracket 50 comes into contact with the cam operation surface of a cam 53 in a cam receiver 81, and is configured to shift in the horizontal direction viewed in the figure with respect to the film transport roller 49, corresponding to rotation in the arrow direction of the cam 53 with a cam shaft 82 as the axis rotating by a drive force of a drive motor 54 (see FIG. 10). Accordingly, when the bracket 50 moves toward the film transport roller 49 (FIGS. 4 and 5), the pinch rollers 32*a*, 32*b* come into press-contact with the film transport roller 49 against the spring members 51 with the transfer film 46 nipped, and wind the transfer film 46 around the film transport roller 49.

At this point, the pinch roller 32*b* in a farther position from a shaft 95 as a rotation axis of the bracket 50 first comes into press-contact with the film transport roller 49, and next, the pinch roller 32*a* comes into press-contact. In this way, by arranging the shaft 95 that is the rotation axis higher than the film transport roller 49, the pinch roller support member 57 comes into contact with the film transport roller 49 while rotating, instead of parallel shift, and there is the advantage that the space in the width direction is less than in the parallel shift.

Further, the press-contact forces when the pinch rollers 32*a*, 32*b* come into press-contact with the film transport roller 49 are uniform in the width direction of the transfer film 46 by the spring members 51. At this point, since the long holes 76, 77 are formed on the opposite sides of the pinch roller support member 57 and the support shaft 58 is fixed to the fix portion 78, it is possible to adjust the pinch roller support member 57 in three directions, and the transfer film 46 is transported in a correct posture by rotation of the film transport roller 49 without causing skew. In addition, adjustments in three directions described herein are to (i) adjust the parallel degree in the horizontal direction of the shafts of the pinch rollers 32*a*, 32*b* with respect to the shaft of the film transport roller 49 to uniform the press-contact forces in the shaft direction of the pinch rollers 32*a*, 32*b* with respect to the film transport roller 49, (ii) adjust shift distances of the pinch rollers 32*a*, 32*b* with respect to the film transport roller 49 to uniform the press-contact force of the pinch roller 32*a* on the film transport roller 49 and the press-contact force of the pinch roller 32*b* on the film transport roller 49, and (iii) adjust the parallel degree in the vertical direction of the shafts of the pinch rollers 32*a*, 32*b* with respect to the shaft of the film transport roller 49 so that the shafts of the pinch rollers 32*a*, 32*b* are perpendicular to the film travel direction.

Furthermore, the bracket 50 is provided with a tension receiving member 52 that comes into contact with a portion of the transfer film 46 which is not wound around the film transport roller 49 when the bracket 50 moves toward the film transport roller 49.

The tension receiving member 52 is provided to prevent the pinch rollers 32*a*, 32*b* from retracting from the film transport roller 49 respectively against the biasing forces of the spring members 51 due to the tension of the transfer film. 46 occurring when the pinch rollers 32*a*, 32*b* bring the transfer film 46 into press-contact with the film transport roller 49. Accordingly, the tension receiving member 52 is attached to the front end of the end portion on the rotation side of the bracket 50 so as to come into contact with the transfer film 46 in the position to the left of the pinch rollers 32*a*, 32*b* viewed in the figure. FIG. 2 shows a state in which the tension receiving member 52 is brought into contact with the transfer film 46.

By this means, the cam 53 is capable of directly receiving the tension occurring due to elasticity of the transfer film 46 through the tension receiving member 52. Accordingly, the pinch rollers 32*a*, 32*b* are prevented from retracting from the film transport roller 49 due to the tension and from decreasing the press-contact forces of the pinch rollers 32*a*, 32*b*, thereby maintain the winding state in which the transfer film 46 is brought into intimate contact with the film transport roller 49, and are able to perform accurate transport.

Figure 9:
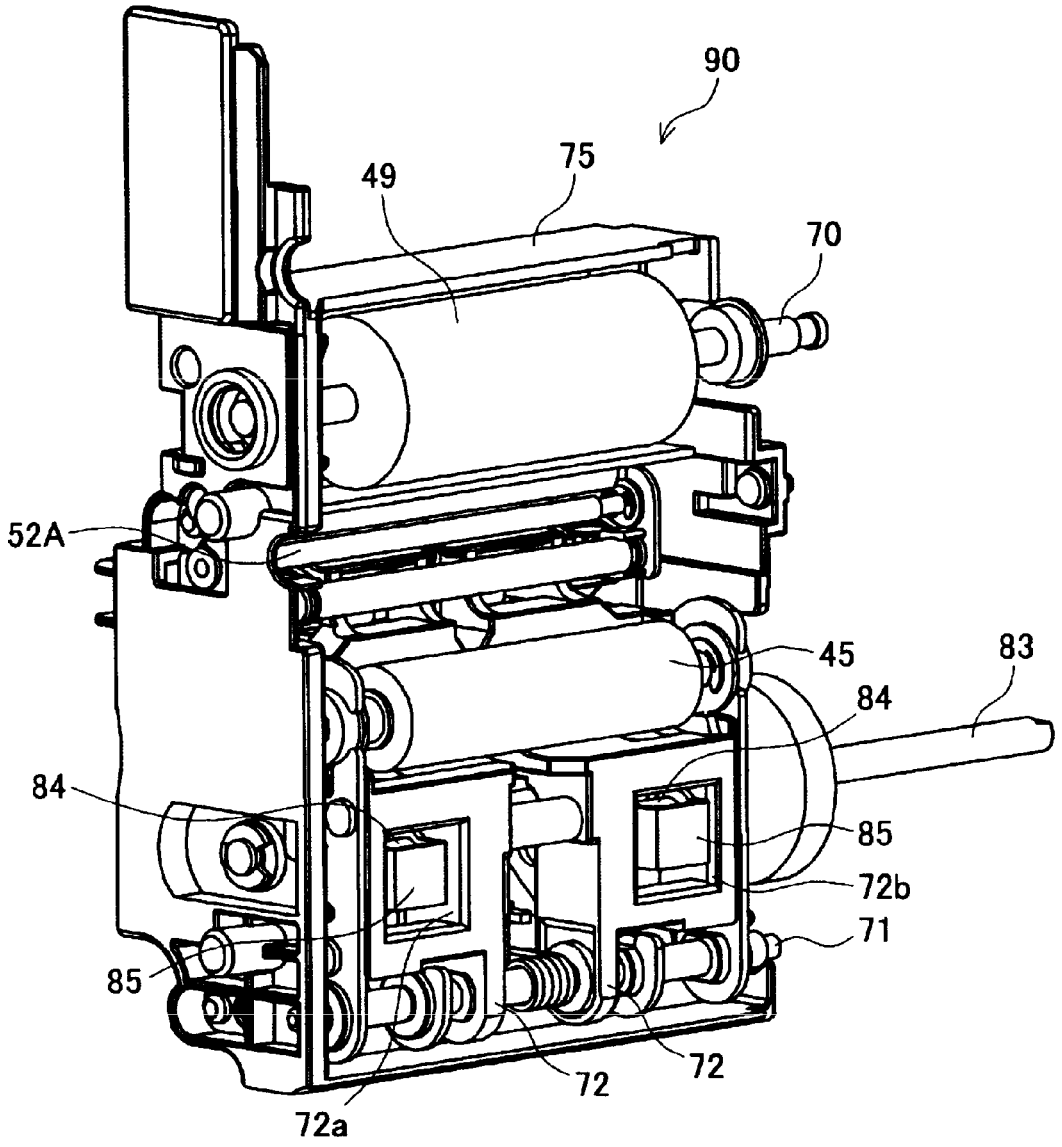
FIG. 9 is an external view showing a configuration of a first unit integrated to incorporate the film transport roller, platen roller and their peripheral parts into the printer.

As shown in FIG. 9, the platen roller 45 disposed along the transverse width direction of the transfer film 46 is supported by a pair of platen support members 72 rotatable on a shaft 71 as the axis. The pair of platen support members 72 support opposite ends of the platen roller 45. The platen support members 72 are respectively connected to end portions of a bracket 50A having the shaft 71 as a common rotating shaft via spring members 99.

The bracket 50A has a substrate 87, and cam receiver support portion 85 formed by bending the substrate 87 in the direction of the platen support member 72, and the cam receiver support portion 85 holds a cam receiver 84. A cam 53A rotating on a cam shaft 83 as the axis driven by the drive motor 54 is disposed between the substrate 87 and the cam receiver support portion 85, and is configured so that the cam operation surface and cam receiver 84 come into contact with each other. Accordingly, when the bracket 50A moves in the direction of the thermal head 40 by rotation of the cam 53A, the platen support members 72 also shift to bring the platen roller 45 into press-contact with the thermal head 40.

The spring members 99 and cam 53A are thus disposed vertically between the bracket 50A and the platen support members 72, and it is thereby possible to store a platen shift unit within the distance between the bracket 50A and the platen support members 72. Further, the width direction is held within the width of the platen roller 45, and it is possible to save space.

Moreover, since the cam receiver support portion 85 is fitted into bore portions 72*a*, 72*b* (see FIG. 9) formed in the platen support members 72, even when the cam receiver support portion 85 is formed while protruding in the direction of the platen support members 72, the distance between the bracket 50A and the platen support members 72 is not increased, and also in this respect, it is possible to save space.

When the platen roller 45 comes into press-contact with the thermal head 40, the spring members 99 connected to respective platen support members 72 act each so as to uniform the press-contact force on the width direction of the transfer film 46. Therefore, when the transfer film 46 is transported by the film transport roller 49, the skew is prevented, and it is possible to perform image formation on the transfer film 46 by the thermal head 40 accurately without the printing region of the transfer film 46 shifting in the width direction.

The substrate 87 of the bracket 50A is provided with a pair of peeling roller support members 88 for supporting opposite ends of the peeling roller 25 via spring members 97, and when the bracket 50A moves to the thermal head 40 by rotation of the cam 53A, the peeling roller 25 comes into contact with the peeling member 28 to peel off the transfer film 46 and ink ribbon 41 nipped between the roller and member. The peeling roller support members 88 are also provided respectively at opposite ends of the peeling roller 25 as in the platen support members 72, and are configured so as to uniform the press-contact force in the width direction on the peeling member 28.

A tension receiving member 52A is provided in an end portion on the side opposite to the end portion on the shaft support 59 side of the bracket 50A. The tension receiving member 52A is provided to absorb the tension of the transfer film 46 occurring in bringing the platen roller 45 and peeling roller 25 respectively into press-contact with the thermal head 40 and peeling member 28. The spring members 99 and 97 are provided so as to uniform the press-contact force on the width direction of the transfer film 46, and in order for the spring members 99 and 97 not to be inversely behind the tension of the transfer film 46 and decrease the press-contact force on the transfer film 46, the tension receiving member 52A receives the tension from the transfer film 46. In addition, since the tension receiving member 52A is also fixed to the bracket 50A as in the above-mentioned tension receiving member 52, the cam 53A receives the tension of the transfer film 46 via the bracket 50A, and is not behind the tension of the transfer film 46. By this means, the press-contact force of the thermal head 40 and platen roller 45 and the press-contact force of the peeling member 28 and peeling roller 25 are held, and it is thereby possible to perform excellent printing and peeling. Further, any error does not occur in the transport amount of the transfer film 46 in driving the film transport roller 49, the transfer film 46 corresponding to the length of the printing region is accurately transported to the thermal head 40, and it is possible to perform printing with accuracy.

The cam 53 and cam 53A are driven by the same drive motor 54 with a belt 98 (see FIG. 3) laid therebetween.

Figure 6:
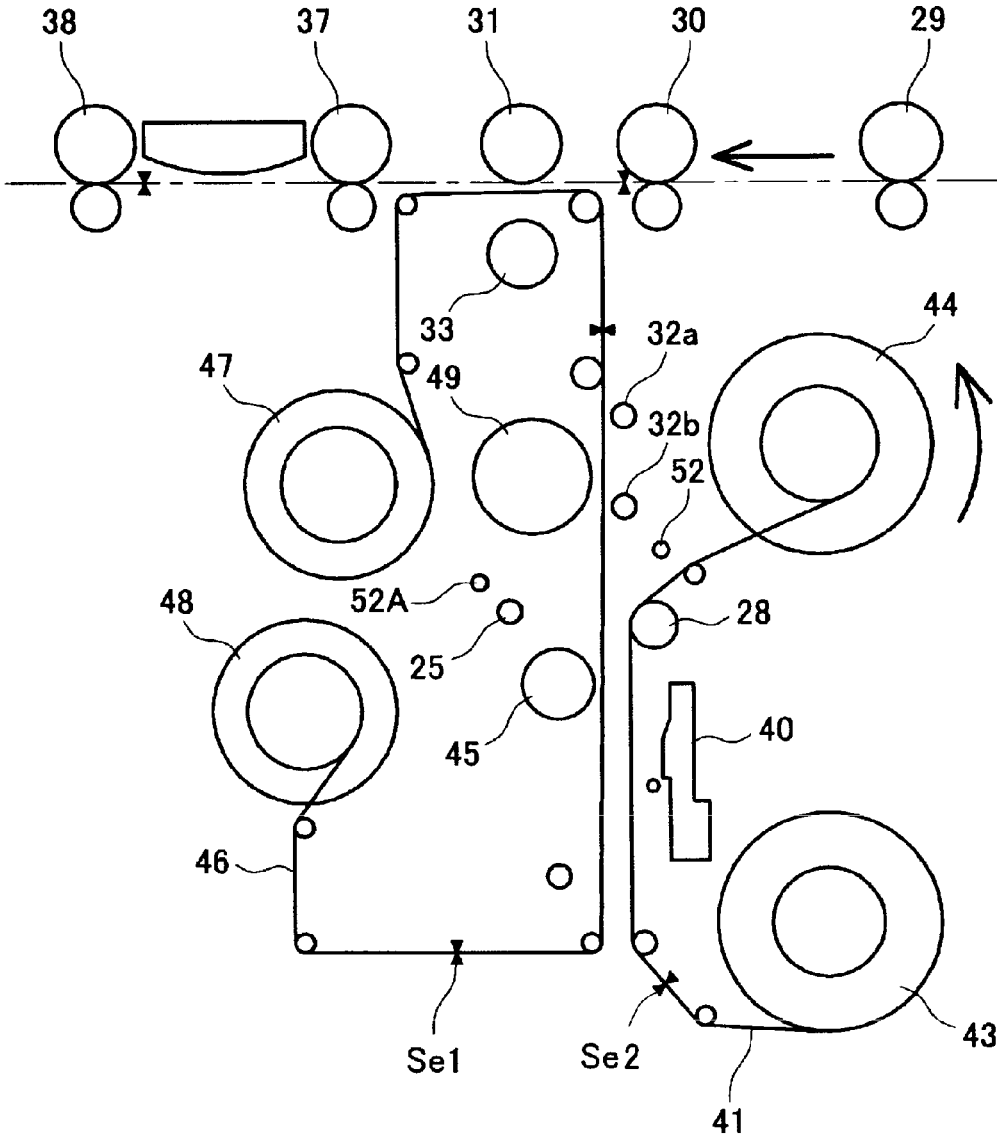
FIG. 6 is an operation explanatory view to explain the state of the waiting position in the printer.

When the printing section B is in a waiting position as shown in FIG. 6, the cam 53 and cam 53A are in the state as shown in FIG. 3, the pinch rollers 32*a*, 32*b* are not brought into press-contact with the film transport roller 49, and the platen roller 45 is not brought into press-contact with the thermal head 40 either. In other words, in the waiting position, the platen roller 45 and thermal head 40 are positioned in separate positions in which the roller 45 and head 40 are separate.

Figure 7:
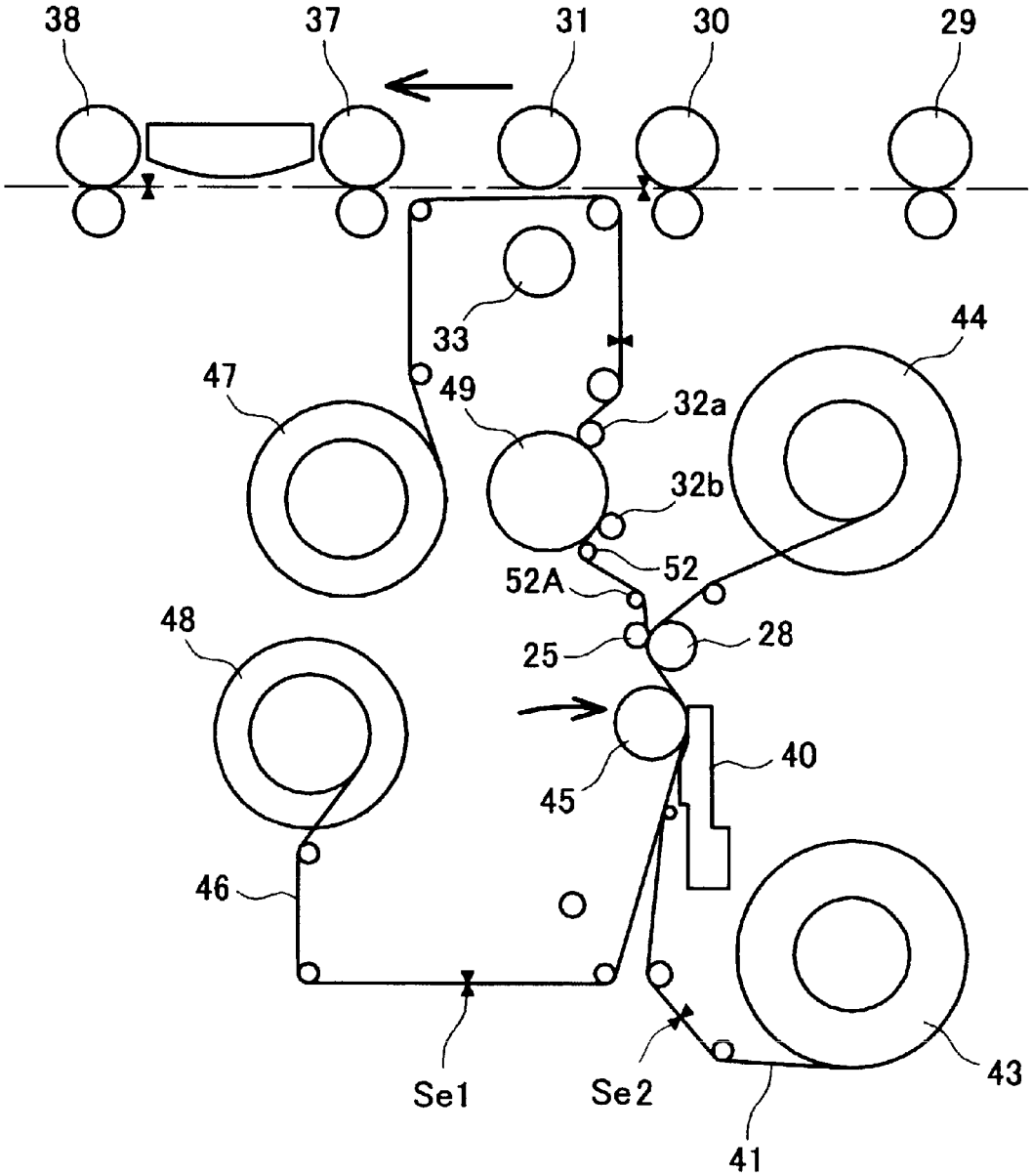
FIG. 7 is an operation explanatory view to explain the state of the transport position in the printer.

Then, when the cam 53 and cam 53A are rotated in conjunction with each other and are in the state as shown in FIG. 4, the printing section B shifts to a printing position as shown in FIG. 7. At this point, the pinch rollers 32*a*, 32*b* first wind the transfer film 46 around the film transport roller 49, and the tension receiving member 52 comes into contact with the transfer film 46. Subsequently, the platen roller 45 comes into press-contact with the thermal head 40. In this printing position, the platen roller 45 shifts toward the thermal head 40 to nip the transfer film. 46 and ink ribbon 41 and come into press-contact, and the peeling roller 25 is in contact with the peeling member 28.

In this state, when transport of the transfer film 46 is started by rotation of the film transport roller 49, at the same time, the ink ribbon 41 is also wound around the wind-up spool 44 by operation of the motor Mr1 and transported in the same direction. During this transport, a positioning mark provided in the transfer film 46 passes through a sensor Se1 and shifts a predetermined amount, and at the time the transfer film 46 arrives at a printing start position, printing by the thermal head 40 is performed on the predetermined region of the transfer film 46. Particularly, since the tension of the transfer film 46 is large during printing, the tension of the transfer film 46 acts on the direction for separating the pinch rollers 32*a*, 32*b* from the film transport roller 49 and the direction for separating the peeling roller 25 and platen roller 45 from the peeling member 28 and thermal head 40. However, as described above, since the tension of the transfer film 46 is received in the tension receiving members 52, 52A, the press-contact forces of the pinch rollers 32*a*, 32*b* are not decreased, it is thereby possible to perform accurate film transport, the press-contact force of the thermal head 40 and platen roller 45 and the press-contract force of the peeling member 28 and peeling roller 25 are not decreased either, and it is thereby possible to perform accurate printing and peeling. The ink ribbon 41 with which printing is finished is peeled off from the transfer film 46 and wound around the wind-up spool 44.

A shift amount by transport of the transfer film 46 i.e. a length in the transport direction of a printing region to undergo printing is detected by an encoder (not shown) provided in the film transport roller 49, rotation of the film transport roller 49 is halted corresponding to detection, and at the same time, winding by the wind-up spool 44 by operation of the motor Mr1 is also halted. By this means, finished is printing with the ink of the first ink panel on the printing region of the transfer film 46.

Figure 8:
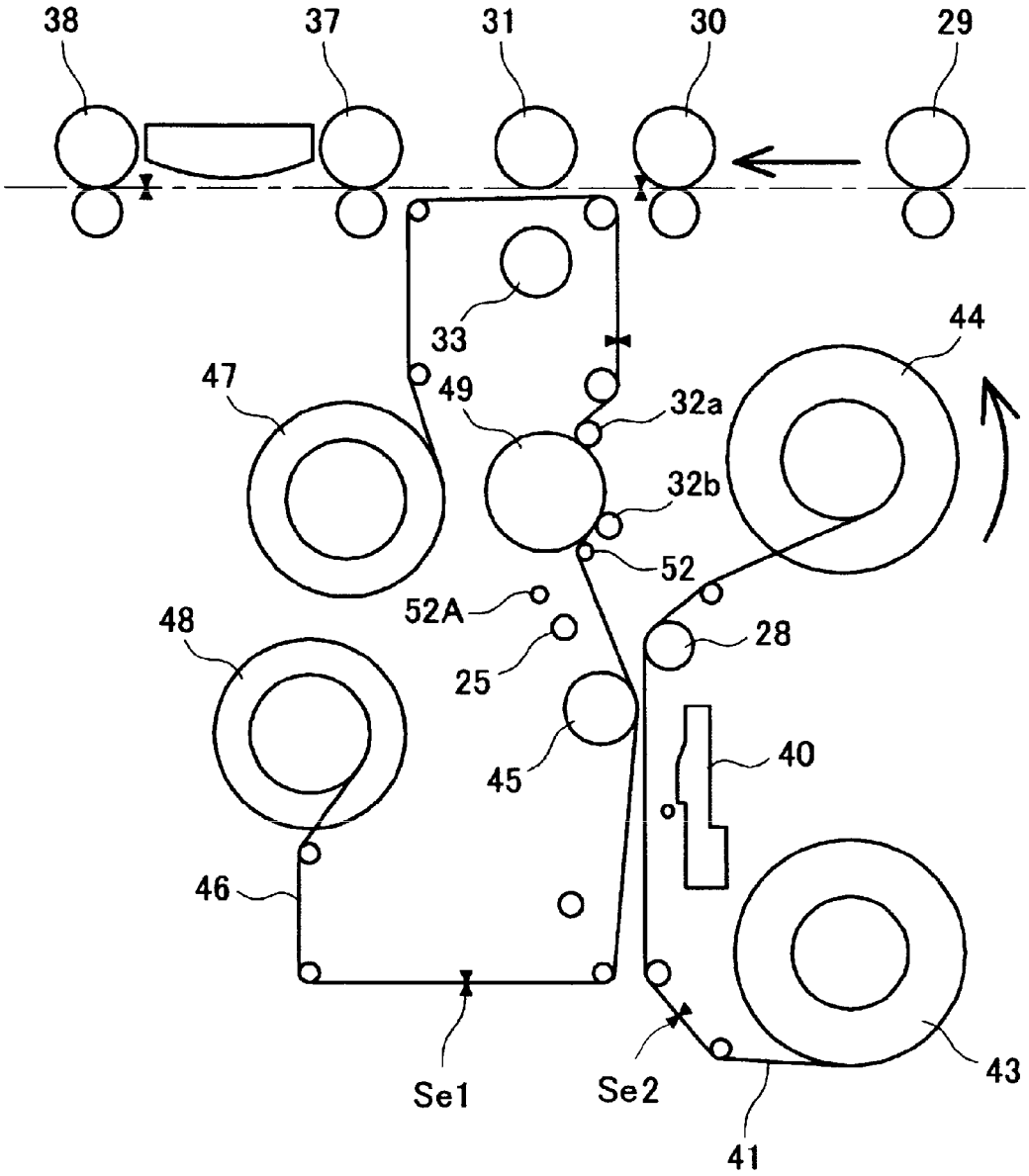
FIG. 8 is an operation explanatory view to explain the state of the printing position in the printer.

Next, when the cam 53 and cam 53A are further rotated in conjunction with each other and are in the state as shown in FIG. 5, the printing section B shifts to a transport position as shown in FIG. 8, and the platen roller 45 returns to the direction of retracting from the thermal head 40. In this state, the pinch rollers 32*a*, 32*b* still wind the transfer film 46 around the film transport roller 49, the tension receiving member 52 is in contact with the transfer film 46, and the transfer film 46 is transported backward to a beforehand determined printing preparation position by rotation in the backward direction of the film transport roller 49. Also at this point, the shift amount of the transfer film 46 is grasped with the rotation amount of the film transport roller 49, and the transfer film 46 is transported backward by a length slightly longer than the length in the transport direction of the printing region subjected to printing. In addition, the ink ribbon 41 is also rewound a predetermined amount with the motor Mr3, and the ink panel of the ink to print next waits in the initial position (feeding position).

Then, the control state by the cam 53 and cam 53A becomes the state as shown in FIG. 4 again and the printing position as shown in FIG. 7, the platen roller 45 is brought into press-contact with the thermal head 40, the film transport roller 49 rotates in the forward direction again to shift the transfer film 46 from the printing preparation position to the printing start position so as to perform positioning (feeding) with respect to the thermal head 40, and printing with the ink of the next ink panel is performed with the thermal head 40.

Thus, the operation in the printing position and transport position is repeated until printing with ink of all or predetermined ink panel is finished. Then, when printing with the thermal head 40 is finished, the image-formed region of the transfer film 46 is transported to the heat roller 33, and at this point, the cam 53 and cam 53A shift to the state as shown in FIG. 3, and release press-contact with the transfer film 46. Subsequently, transfer to the card Ca is performed while transporting the transfer film 46 by driving of the wind-up spool 47.

Such a printing section B is divided into three units 90, 91, and 92.

As shown in FIG. 9, in the first unit 90, a unit frame body 75 is installed with a drive shaft 70 that rotates by driving of the motor 54 (see FIG. 10), and the drive shaft 70 is inserted in the film transport roller 49. Below the film transfer roller 49 are disposed the bracket 50A and a pair of platen support members 72, and these members are supported rotatably by the shaft 71 laid between opposite side plates of the unit frame body 75.

In FIG. 9, a pair of cam receiver support portions 85 that are apart of the bracket 50A appear from the bore portions 72*a*, 72*b* formed in the platen support members 72. The cam receiver support portions 85 hold a pair of cam receivers 84 disposed at the back thereof. Then, at the back of the cam receivers 84 is disposed the cam 53A installed in the cam shaft 83 inserted in the unit frame body 75. The cam shaft 83 is laid between opposite side plates of the unit frame body 75.

Figure 11:
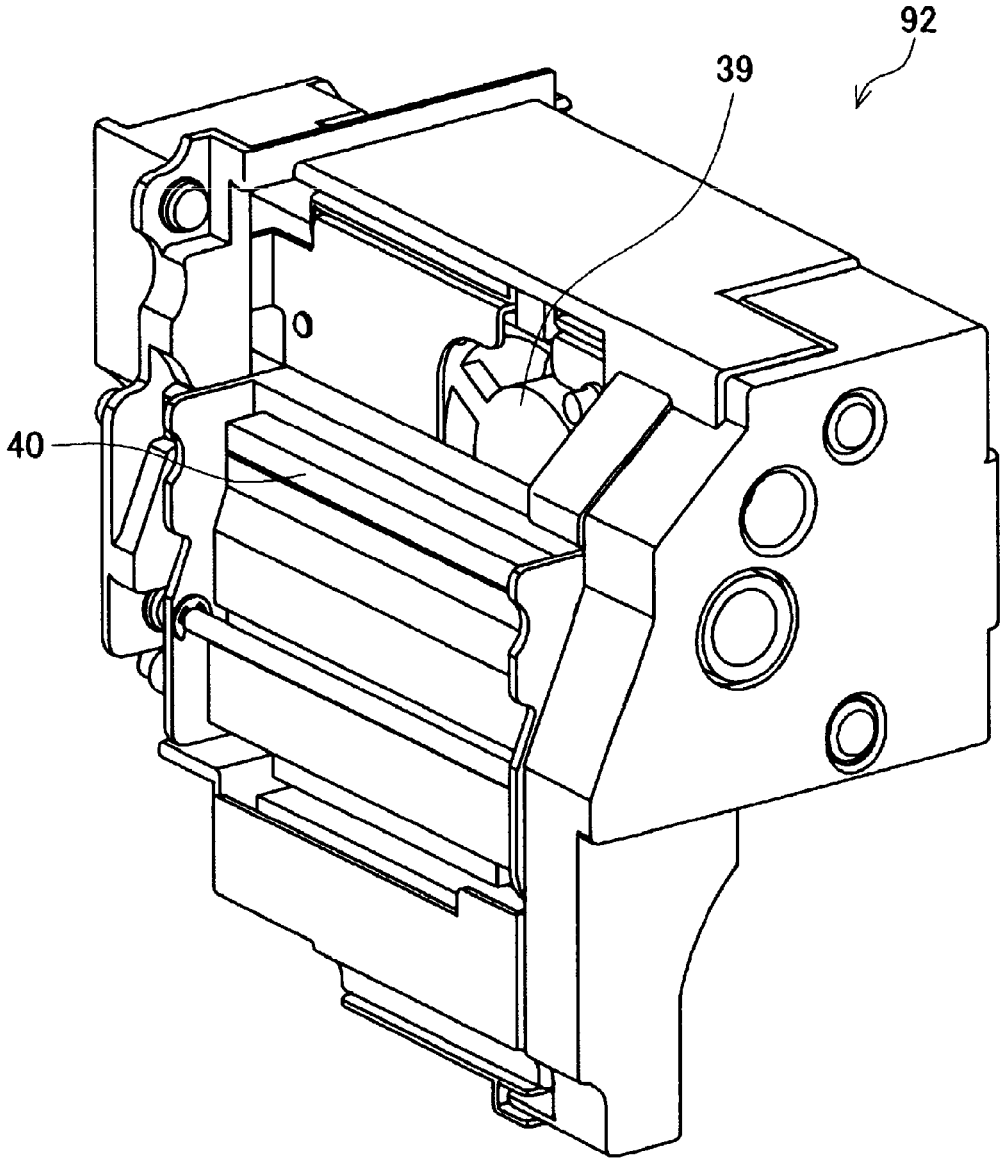
FIG. 11 is an external view of a third unit integrated to incorporate the thermal head into the printer.

The above-mentioned thermal head 40 is disposed in the position opposed to the platen roller 45 with a transport path of the transfer film 46 and ink ribbon 41 therebetween. The thermal head 40, members related to heating and cooling fan 39 are integrated into the third unit 92 as shown in FIG. 11, and are disposed opposite the first unit 90.

The first unit 90 collectively holds the platen roller 45, peeling roller 25 and tension receiving member 52A varying in position by printing operation in the movable bracket 50A, and thereby eliminates the need of position adjustments among the members. Moreover, by shifting the bracket 50A by rotation of the cam 53, it is possible to shift the members to predetermined positions. Further, since the bracket 50A is provided, it is possible to store in the same unit as that of the fixed film transport roller 49, the transport drive portion by the film transport roller 49 required to transport the transfer film with accuracy and the transfer position regulation portion by the platen roller 45 are included in the same unit, and therefore, the need is eliminated for position adjustments between both portions.

As shown in FIG. 10, in the second unit 91, the cam shaft 82 installed with the cam 53 is inserted in a unit frame body 55, and is coupled to an output shaft of the drive motor 54. Then, the second unit 91 supports the bracket 50 in the unit frame body 55 movably to come into contact with the cam 53, and to the bracket 50 are fixed the support shaft 58 that supports the pinch roller support member 57 rotatably and the tension receiving member 52.

In the pinch roller support member 57, the spring members 51*a*, 51*b* are attached to the support shaft 58, and their end portions are respectively brought into contact with the opposite ends of the pinch roller support member 57 that supports the pinch rollers 32*a*, 32*b* to bias to the direction of the film transport roller 49. In the pinch roller support member 57, the support shaft 58 is inserted in the long holes 76, 77, and is fixed and supported in the center portion by the bracket 50.

A spring 89 for biasing the pinch roller support member 57 toward the bracket 50 is provided between the bracket 50 and the pinch roller support member 57. By this spring 89, the pinch roller support member 57 is biased in the direction of moving backward from the film transport roller 49 of the first unit 90, and therefore, it is possible to easily pass the transfer film 46 through between the first unit 90 and the second unit 91 in setting the transfer film cassette in the printer 1.

The second unit 91 holds the pinch rollers 32*a*, 32*b*, and tension receiving member 52 varying in position corresponding to printing operation in the bracket 50A, shifts the pinch rollers 32*a*, 32*b* and tension receiving member 52 by shifting the bracket 50A by rotation of the cam 53, and thereby simplifies position adjustments between the rollers and member, and position adjustments between the pinch rollers 32*a*, 32*b* and the film transport roller 49. Such a second unit 91 is disposed opposite the first unit 90 with the transfer film 46 therebetween.

By thus making the units, it is also possible to pull each of the first unit 90, second unit 91 and third unit 92 out of the main body of the printer 1 as in the cassette of each of the transfer film 46 and ink ribbon 41. Accordingly, in replacing the cassette due to consumption of the transfer film 46 or ink ribbon 41, when the units 90, 91 and 92 are pulled out as required, it is possible to install the transfer film 46 or ink ribbon 41 readily inside the apparatus in inserting the cassette.

As described above, by combining the first unit 90 into which are integrated the platen roller 45, bracket 50A, cam 53A, and platen support members 72, and the second unit 91 into which are integrated the pinch rollers 32*a*, 32*b*, bracket 50, cam 53 and spring members 51, and placing and installing the third unit 92 with the thermal head 40 attached thereto opposite the platen roller 45, it is possible to perform assembly in manufacturing the printer and adjustments in maintenance with ease and accuracy. Moreover, by integrating, it is possible to perform removal from the apparatus with ease, and the handleability as the printer is improved.

Described next is control and electric system of the printer 1. As shown in FIG. 12, the printer 1 has a control section 100 that performs operation control of the entire printer 1, and a power supply section 120 that transforms utility AC power supply into DC power supply that enables each mechanism section, control section and the like to be driven and actuated.

<Control Section>

As shown in FIG. 12, the control section 100 is provided with a microcomputer 102 that performs entire control processing of the printer 1. The microcomputer 102 is comprised of a CPU that operates at fast clock as the central processing unit, ROM in which are stored programs, pattern data described later and the like of the printer 1, RAM that works as a work area of the CPU, and internal buses that connect the components.

The microcomputer 102 is connected to external buses. The external bus is connected to an interface, not shown, to communicate with the higher apparatus 201, and buffer memory 101 to temporarily store printing data to print on the card Ca, recording data to magnetically or electrically record in a magnetic stripe or stored IC of the card Ca, and the like.

Further, the external bus is connected to a sensor control section 103 that controls signals from various sensors, an actuator control section 104 that includes motor drivers and the like for supplying drive pulses and drive power to respective motors, a thermal head control section 105 to control thermal energy to the heating elements constituting the thermal head 40, an operation display control section 106 to control the operation panel section 5, and the above-mentioned information recording section A.

(Power Supply Section)

The power supply section 120 supplies operation/drive power to the control section 100, thermal head 40, heat roller 33, operation panel section 5, information recording section A and the like.

<Features of the Printer>

Described next are features of the printer 1 of this Embodiment.

Figure 13:
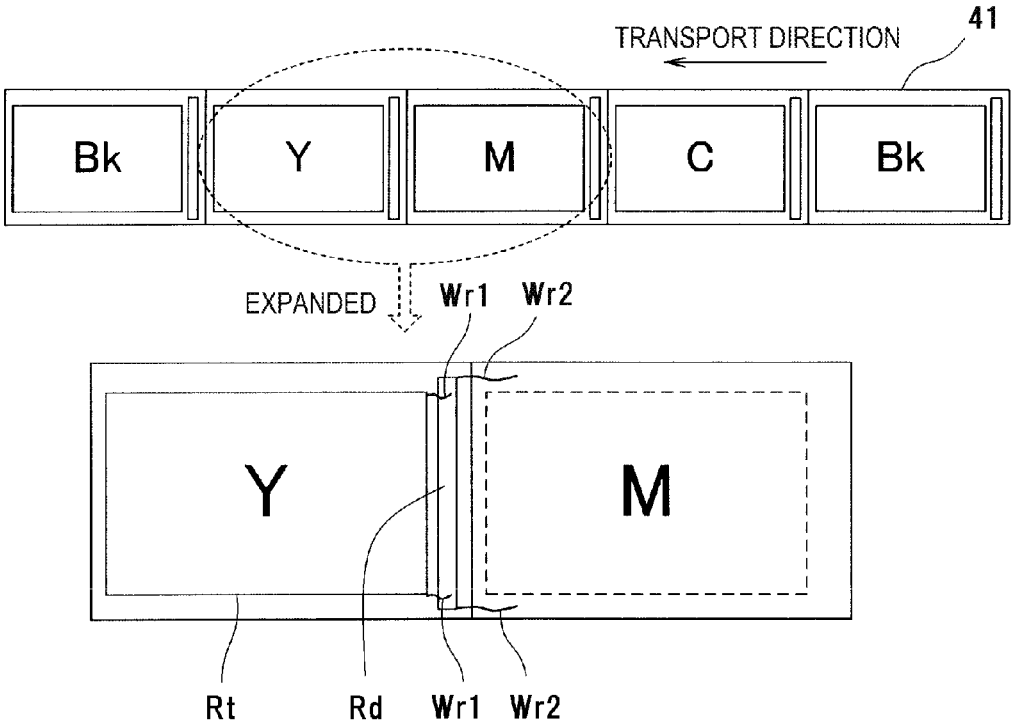
FIG. 13 is an explanatory view schematically showing wrinkles arising in an ink ribbon immediately after forming an image on a transfer film using a Y ink panel that is the first panel of an ink ribbon in the printer of the Embodiment.

One of the features of the printer 1 of this Embodiment is that the control section 100 controls the image formation section B1 so as to transport the ink ribbon 41 and the transfer film 46 at the same velocity, and form a dummy image wider than a printing image on the opposite sides in the width direction crossing the transport direction of the transfer film 46 at the back of the printing image in the transport direction. By this means, as shown in FIG. 13, on the ink ribbon 41, it is possible to relax the effect of the wrinkle Wr1, which occurs in the rear end corner portion in the transport direction of the printing region Rt corresponding to the printing image of the transfer film 46, to stem (prevent conveyance to the next M ink panel) by a sag caused by that the ink is removed in the dummy printing region Rd of the ink ribbon 41 corresponding to the dummy image, and since the dummy printing region Rd is wider than the printing region Rt on the width-direction opposite sides, the wrinkle Wr2 itself occurring in the rear end corner portion of the dummy printing region Rd in the transport direction does not affect the printing region (region shown by dashed lines in FIG. 13) of the next M panel. It is thereby possible to prevent the reduction in printing quality caused by the wrinkle of the ink ribbon. In addition, in FIG. 13, it is shown that the maximum region in which an image is formed on the transfer film 46 in the Y ink panel (Y ink panel undergoes printing) is indicated as the printing region Rt, and that the dummy printing region Rd exhibits a rectangular shape. Further, FIG. 13 exemplifies the Y ink panel, and the other ink panels of M, C and Bk undergo the same.

Further, another feature of the printer 1 of this Embodiment is that the control section 100 controls the image formation section B1 so as to form the printing image and the dummy image by a series of operation. By bringing the thermal head 40 into press-contact with the ink ribbon 41 and continuously operating the heating elements on the printing region Rt and dummy printing region Rd of the ink ribbon 41, the printing image and the dummy image are formed on the transfer film 46 by a series of operation. When the dummy image is formed on the transfer film 46 using the dummy printing region Rd of the Y ink panel immediately before printing on the printing region of the M ink panel, the ink ribbon 41 is already transported a long distance by peeling operation after Y ink panel printing, feeding operation described later and the like, the wrinkle caused by the level difference occurs, and it is not possible to obtain the effect of preventing the wrinkle as described above.

Furthermore, still another feature of the printer 1 of this Embodiment is that the control section 100 controls the image formation section B1 so that gradation values of pixels inside a region of the dummy image are the same (the dummy image is the so-called solid image). By setting pixels at the same gradation value, the wrinkle Wr1 shown in FIG. 13 is stopped inside the dummy printing region Rd with the ink removed uniformly, and the wrinkle Wr2 is generated reliably in the rear end corner portion of the dummy printing region Rd in the transport direction, and is prevented from extending to the printing region of the M ink panel. Such gradation values are not limited particularly, and in consideration of the effect of relaxing the effect of the wrinkle Wr1 to stem by the sag that the ink is removed in the dummy printing region Rd, it is preferable to set high gradation values (for example, gradation values in the range of 127 to 255 in the case of using 256-level gradation (gradation values of 0 to 255)).

<Dimensions of the Ink Ribbon, etc.>

To facilitate understanding of the present invention, dimensions of each of the ink ribbon 41, printing region Rt, dummy printing region Rd and the like used in the Example will be described next according to the printer 1 of this Embodiment for reference.

Figure 14:
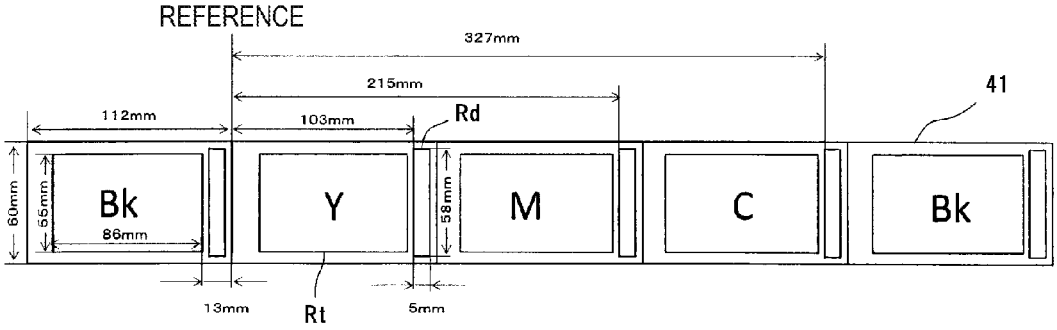
FIG. 14 is an explanatory view showing dimensions of the ink ribbon, printing region and dummy printing region used in the printer of the Embodiment.

As shown in FIG. 14, as dimensions of each of ink panels Y, M, C, Bk of the ink ribbon 41, the horizontal dimension (length in the transport direction) is set at 112 mm, and the vertical dimension (length in the width direction crossing the transport direction) is set at 60 mm. As dimensions (maximum dimensions subjected to printing) of the printing region Rt of each ink panel, the horizontal dimension is set at 86 mm, and the vertical dimension is set at 55 mm. As dimensions of the dummy printing region Rd, the horizontal dimension is set at 5 mm, and the vertical dimension is set at 58 mm. The length from the rear end of the printing region Rt of each ink panel to the panel rear end is set at 13 mm, and the length from the front end of each ink panel to the dummy printing region Rd is set at 103 mm. The printing region Rt is disposed at the center of each ink panel, and there is the distance of 13 mm between the front end of each ink panel and the front end of the printing region Rt and between the rear end of the printing region Rt and the panel rear end. The dummy printing region Rd with a width of 5 mm is formed at the center of this distance. Further, since vertical dimensions of the printing region Rt and dummy printing region Rd are 55 mm and 58 mm, respectively, the vertical dimension of the dummy printing region Rd is longer (wider) than the vertical dimension of the printing region Rt on the opposite sides in the vertical direction (width direction crossing the transport direction of the ink ribbon 41) each by 1.5 mm. In addition, in the Example were used the transfer film 46 with the length in the width direction crossing the transport direction of 60 mm, and the card Ca with the horizontal dimension of 85.6 mm and the vertical dimension of 54 mm.

<Operation>

Next, a printing routine by the printer 1 of this Embodiment will be described with emphasis on the CPU (hereinafter, simply referred to as CPU) of the microcomputer 102. In addition, to simplify the description, the description will be given while assuming that initial setting processing for decompressing programs and the like stored in the ROM in the RAM, and positioning each of members constituting the printer 1 in a home (initial) position is finished, and that printing data (color component printing data of Y, M, C and printing data of Bk), magnetic or electric recording data and the like are already received from the higher apparatus 201.

(Image Formation)

In the printing routine, first, the image formation section B1 performs image formation processing for forming the printing image (mirror image) in a predetermined region on the transfer film 46 and the dummy image at the back of the region.

In other words, according to the color component printing data of Y, M, C and printing data of Bk input (stored in the buffer member 101), first, the transfer film 46 is positioned in the above-mentioned printing start position, feeding of the Y ink panel of the ink ribbon 41 is performed ("reference" position shown in FIG. 14 is transported to a beforehand determined position), the ink ribbon 41 and transfer film 46 are transported at the same velocity while supporting the back side (opposite surface side to the image formation surface) of the transfer film 46 by the platen roller 45, the heating elements of the thermal head 40 brought into press-contact with the ink ribbon 41 are selectively operated according to the printing data of Y to form a printing image of Y ink in a predetermined region of the transfer film 46, and by continuously operating the heating elements of the thermal head 41, a dummy image (rectangular solid image in this example) wider than the printing image in the width direction of the transfer film. 46 is formed at the back in the transport direction of the printing image of Y ink. In addition, the CPU outputs the printing data of Y to the thermal head 40 for each line via the thermal head control section 105, and thereby heats and controls the heating elements lined in the main scanning direction.

As shown in FIG. 14, on the transfer film 46, the printing image of Y ink is formed with the Y ink of the printing region Rt of the Y ink panel, and the dummy image is formed with the Y ink of the dummy printing region Rd of the Y ink panel. In addition, in this Embodiment, default values of dimensions, position, gradation value and the like of the dummy image are beforehand stored in the ROM, the CPU forms the dummy image on the transfer film 46 with the ink of the ink ribbon 41 according to the default values, and it is configured that the dimensions, position, gradation value and the like of the dummy image are capable of being changed by manual input by an operator from the operation panel section 5 or higher apparatus 201.

After the printing image and dummy image with the Y ink are formed on the transfer film 46, and the ink ribbon 41 and transfer film 46 are peeled off with the peeling roller 25 and peeling member 28, the transfer film 46 is transported backward to the above-mentioned printing preparation position. Next, the transfer film 46 is shifted from the printing preparation position to the printing start position, feeding of the M ink panel of the ink ribbon 41 is performed, as in the case of formation of the printing image with the printing data of Y and dummy image, a printing image of M ink is formed in the predetermined position of the transfer film 46 according to the printing data of M, the dummy image wider than the printing image of M ink is continuously formed at the back in the transport direction of the printing image of M ink by operating the heating elements of the thermal head 41, and in this state, the ink ribbon 41 and the transfer film 46 are peeled off. Subsequently, similarly, the section performs formation of a printing image with the printing data of C and dummy image and peeling, and formation of a printing image with the printing data of Bk and dummy image and peeling.

By the image formation processing, printing images with Y, M, C and Bk inks of the ink ribbon 41 are superimposed and a color printing image (mirror image) is formed in the predetermined region of the transfer film 46. The CPU controls a stepping motor, not shown, which drives the film transport roller 49 so that respective printing images of Y, M, C and Bk inks are superimposed in the predetermined region of the transfer film 46 i.e. that printing start positions of respective printing images are the same as one another. In addition, in this Embodiment, after an image of one surface side of the card Ca is formed in the predetermined region of the transfer film 46, an image of the other surface side is formed in the next region of the transfer film 46.

(Card Transport)

In parallel with the image formation processing, the CPU feeds out the card Ca from the media storage section C, based on the received magnetic or electric recording data performs recording processing on the card Ca in one of the magnetic recording section 24, non-contact type IC recording section 23, and contact type IC recording section 27 constituting the information recording section A, and then, transports the card Ca to the transfer section B2.

(Transfer)

Next, in the transfer section B2, the CPU performs transfer processing for transferring the color printing image formed on the transfer film 46 to the card Ca. In this transfer processing, the CPU controls so that the card Ca and the image formed in the predetermined region (or the next region) of the transfer film 46 arrive at the transfer section B2 in synchronization with each other. In addition, after transferring the image to one surface of the card Ca, the CPU transports the card Ca to the rotating unit F side to rotate the card Ca 180°, and transfers the image for the other surface to the other surface of the card Ca.

(Card Discharge)

Next, the CPU corrects a curl of the card Ca occurring in thermal transfer with the heat roller 33 in the decurl mechanism 36, then discharges the card Ca toward the storage stacker 60, and finishes the printing routine.

<Effects, etc.>

The effects and the like of the printer 1 of this Embodiment will be described next.

In the printer 1 of this Embodiment, the control section 100 controls the image formation section B1 so as to transport the ink ribbon 41 and the transfer film 46 at the same velocity, and form a dummy image wider than a printing image on the width-direction opposite sides of the transfer film 46 at the back of the printing image in the transport direction. By this means, as shown in FIG. 13, on the ink ribbon 41, it is possible to relax the effect of the wrinkle Wr1, which occurs in the rear end corner portion in the transport direction of the printing region Rt corresponding to the printing image of the transfer film 46, to stem by a sag caused by that the ink is removed in the dummy printing region Rd of the ink ribbon 41 corresponding to the dummy image, and since the dummy printing region Rd is wider than the printing region Rt on the width-direction opposite sides, the wrinkle Wr2 itself occurring in the rear end corner portion of the dummy printing region Rd in the transport direction does not affect the printing region of the next ink panel. It is thereby possible to prevent the reduction in printing quality caused by the wrinkle of the ink ribbon.

Further, in the printer 1 of this Embodiment, the control section 100 controls the image formation section B1 so as to form the printing image and the dummy image by a series of operation (continuously). For example, when the dummy image is formed on the transfer film 46 using the dummy printing region Rd of the Y ink panel immediately before printing on the printing region Rt of the M ink panel, the ink ribbon 41 is already transported a long distance by peeling operation after Y ink panel printing, feeding operation and the like, and the wrinkle caused by the level difference occurs. In the contrast thereto, in the case of forming the printing image and the dummy image by a series of operation, it is possible to reliably exert the effect of preventing the wrinkle as described above.

Furthermore, in the printer 1 of this Embodiment, the control section 100 controls the image formation section B1 so that gradation values of pixels inside a region of the dummy image are the same. Therefore, as shown in FIG. 13, the wrinkle Wr1 is stopped inside the dummy printing region Rd with the ink removed uniformly, and it is possible to generate the wrinkle Wr2 reliably in the rear end corner portion of the dummy printing region Rd in the transport direction to prevent from extending to the printing region of the next ink panel.

Figure 15A:
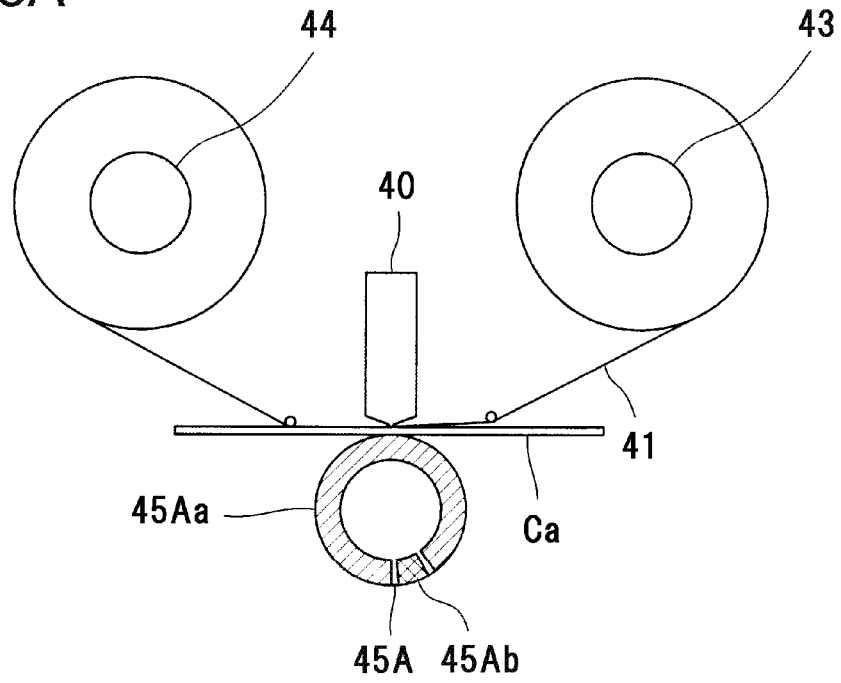
FIGS. 15A and 15B contain explanatory views of an image formation section of the printer of another Embodiment to which the invention is applicable, where
Figure 15B:
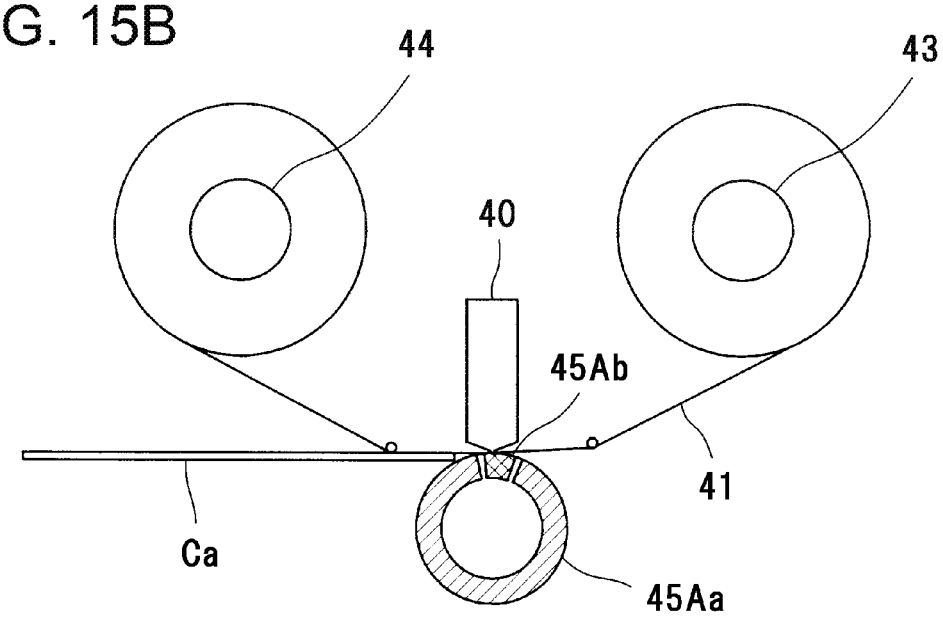

In addition, this Embodiment exemplifies the printer 1 of the indirect printing scheme, and the present invention is also applicable to a printer of the direct printing scheme. FIGS. 15A and 15B show one example of an image formation section of such a printer using the direct printing scheme. The image formation section of this printer has the thermal head 40 with a plurality of heating elements arranged and a platen roller 45A disposed opposite the thermal head 40, transports the ink ribbon 41 and card Ca at the same velocity while supporting the back side of the card Ca by the platen roller 45A, and directly forms an image with each ink of the ink ribbon 41 on the image formation surface side of the card Ca.

The respect to note herein is that it is possible to receive the dummy image on the transfer film 46 (form the dummy image on the transfer film 46) in the case of using the transfer film 46 as a medium as in the above-mentioned Embodiment, and that in the case of the direct transfer scheme, it is not possible to receive the dummy image (ink of the dummy printing region Rd) on the card Ca as a medium. Therefore, the circumferential length of the platen roller 45A is set to be longer than the length of the card Ca in the transport direction, and the platen roller 45A has a first circumferential area 45Aa to support the back side of the transported card Ca, and a second circumferential area (region) 45Ab to receive ink of the dummy printing region Rd of the ink ribbon 41, on the circumferential surface.

Further, an encoder, not shown, is fitted into the roller shaft of the platen roller 45A, and by referring to information output from the encoder, the control section 100 performs control for aligning the front end of the card Ca with the first and second circumferential surfaces. In other words, the section controls so that as shown in FIG. 15A, in forming the printing image with ink of each ink panel on the card Ca, the back side of the card Ca is supported on the first circumferential area 45Aa of the platen roller 45A, while an image is formed on the image formation surface side of the card Ca, and that as shown in FIG. 15B, the second circumferential area 45Ab of the platen roller 45A receives ink of the dummy printing region Rd of each ink panel. In this case, the printer further has a clean roller (not shown) for cleaning the ink received in the second circumferential area 45Ab of the platen roller 45A, and the control section 100 may control the clean roller to come into contact with or retract from the second circumferential area 45Ab by referring to the information output from the encoder not shown.

Furthermore, this Embodiment exemplifies the ink ribbon 41 with ink panels of Y, M, C, and Bk repeated in a face sequential manner, but the present invention is not limited thereto. For example, in the case of single color printing, an ink ribbon of a single color (for example, Bk) may be used, and in the case of color printing, ink panels of cold and silver may be used in addition to Y, M, C and Bk. Further, the ink ribbon may have a panel of a protective layer to cover the surface of the card Ca. Furthermore, an ink ribbon may be used where ink panels of two colors are repeated in a face sequential manner.

Still furthermore, this Embodiment shows the example that the printing image and dummy image are formed on the transfer film 46 using the ink of the printing region Rt and dummy printing region Rd of each of ink panels of Y, M, C and Bk, but the present invention is not limited thereto. For example, since any wrinkle does not occur in an ink panel of which ink is not used in the printing region Rt among ink panels of a plurality of colors, with respect to the ink panel, it is not necessary to form the dummy image on the transfer film 46 using the ink of the dummy printing region Rd.

Moreover, in the dye ink panel and pigment ink panel, being caused by the particle diameter of the ink, the wrinkle caused by the level difference tends to occur in the pigment predominantly. In this Embodiment, as described above, since the pigment ink is used in the ink panel of Bk, for example, only in the case of forming the printing image on the transfer film 46 using the Bk ink of the printing region Rt of the Bk ink panel, the dummy image may be formed in the rear end in the transport direction of the printing image, using the Bk ink of the dummy printing region Rd of the Bk ink panel, and also in this case, the significant effect is exerted to prevent reduction in printing quality caused by the wrinkle of the ink ribbon. In addition, since there is the case where pigment ink is also used in the above-mentioned ink panels of a plurality of colors, in the case of forming the printing image on the transfer film 46 using the ink panel of pigment ink, similarly, the dummy image may be formed using the ink of the dummy printing region Rd of the ink panel of pigment ink. Accordingly, the ink ribbon has panels of a plurality of colors of dye ink panel and pigment ink panel, and the control section 100 may control the image formation section B1 to form the dummy image by operating heating elements on at least the pigment ink panel among ink panels.

Figure 16A:
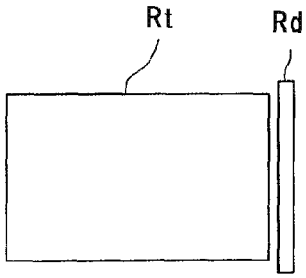
FIGS. 16A to 16F contain explanatory views to schematically explain Modifications of the printing region and dummy printing region, where
Figure 16B:
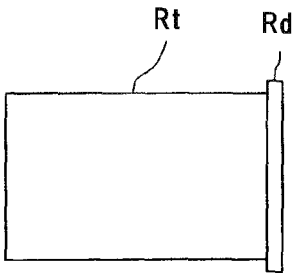
Figure 16C:
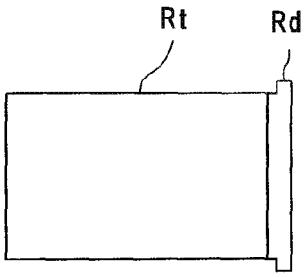
Figure 16D:
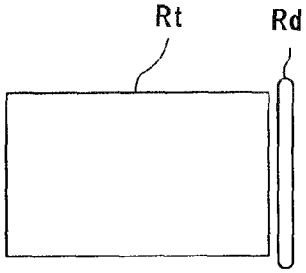
Figure 16E:
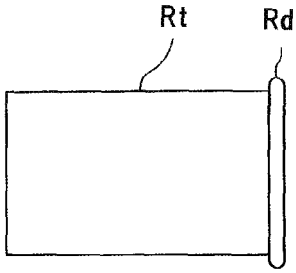
Figure 16F:
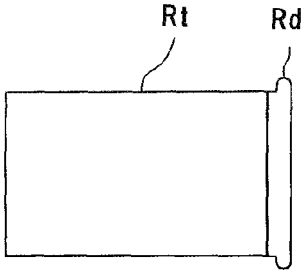
Figure 17A:
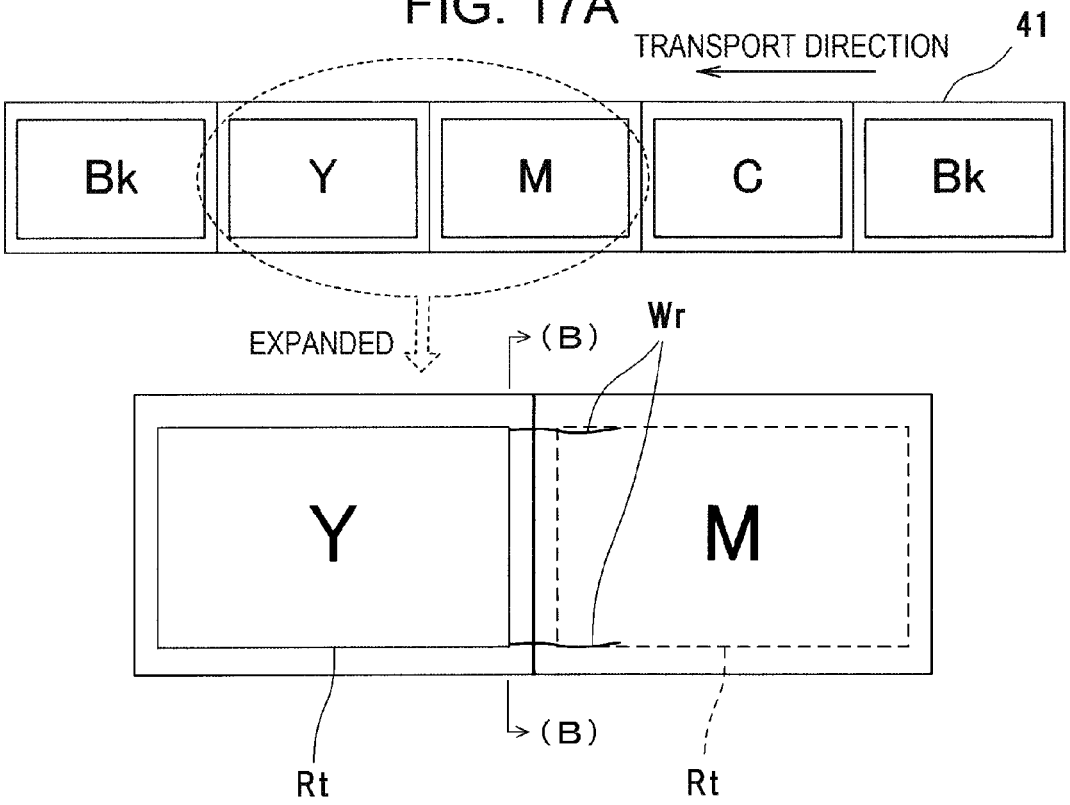
FIGS. 17A and 17B contain explanatory views to schematically explain wrinkles occurring in the ink ribbon of a conventional printer, where
Figure 17B:
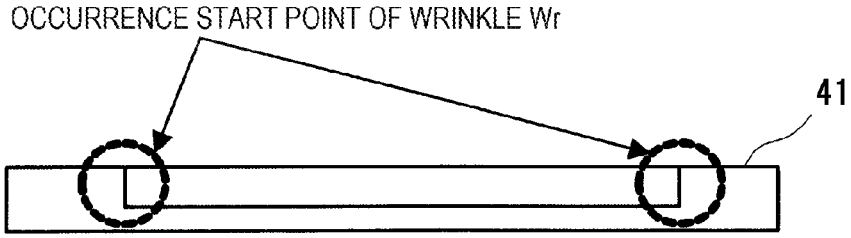
Figure 18A:
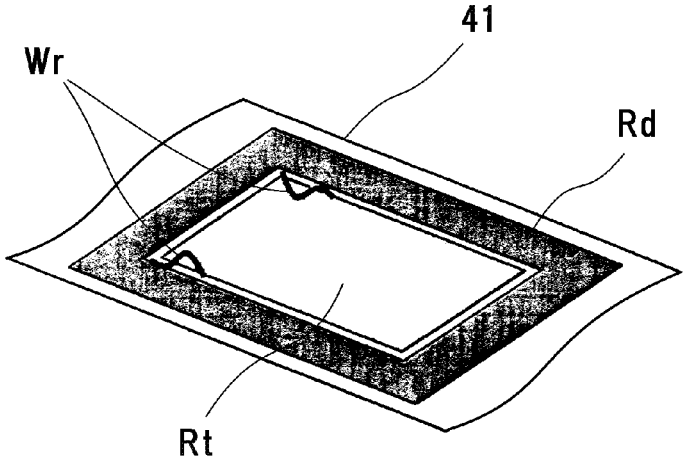
FIGS. 18A and 18B contain explanatory views schematically showing wrinkles arising in the ink ribbon in the case of applying conventional techniques, where
Figure 18B:
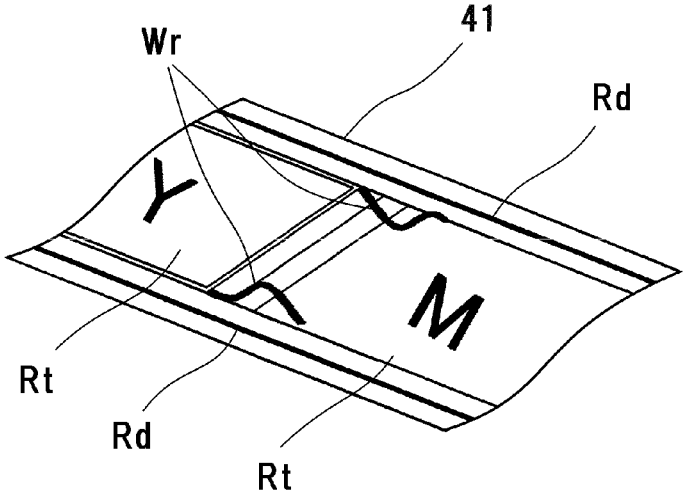

Further, this Embodiment shows the example where the printing region Rt and the dummy printing region Rd are separated in each ink panel of the ink ribbon 41 and the dummy printing region Rd is in the shape of a rectangle (see FIG. 16A), but the present invention is not limited thereto, and allows various modifications thereof. For example, the printing region Rt and the dummy printing region Rd may be continued (see FIGS. 16B, 16C, 16E, and 16F), or each of the width-direction opposite end portions of the dummy printing region Rd may be in the shape of an arc (see FIGS. 16D to 16F). In addition, in the case of continuously forming the printing region Rt and the dummy printing region Rd, one printing data may be newly generated to integrate the printing image and the dummy image formed on the transfer film 46. Such generation of new printing data may be performed on the higher apparatus 201 side, or may be performed on the printer 1 (control section 100) side.

Furthermore, this Embodiment shows the example where the length in the width direction of the dummy printing region Rd is fixed to a certain value (58 mm in the Example, see FIG. 14), but the present invention is not limited thereto, and the length may be varied corresponding to the printing data. For example, as the length in the width direction of the dummy printing region Rd of the Y ink panel, it may be determined which is longer the Y ink or the M ink in the width that the ink of the printing region Rt of the Y ink panel or the M ink panel is subjected to printing by referring to the printing data of Y and M to make longer than the longer width by a predetermined length (for example, 1.5 mm) on the width-direction opposite sides. Alternatively, by referring to the printing data of Y, M, C and Bk, the length may be made longer by a predetermined length on the width-direction opposite sides than the longest ink width among widths that the ink of printing regions Rt of the ink panels of Y, M, C and Bk is subjected to printing.

Still furthermore, this Embodiment shows the example where the image formation section B1 forms an image of one surface side of the card Ca in a predetermined region of the transfer film 46, and then, forms an image of the other surface side in a next region of the transfer film 46, the transfer section B2 transfers the image to one surface of the card Ca, the card Ca is then transported to the rotating unit F side and is rotated 180°, and the image for the other surface is transferred to the other surface of the card Ca, and another configuration may be adopted where the image formation section B1 forms an image of one surface side of the card Ca in a predetermined region of the transfer film 46, after the transfer section B2 transfers the image to one surface of the card Ca or during transfer, the image formation section B1 forms an image of the other surface side in a next region of the transfer film 46, the card Ca is transported to the rotating unit F side and is rotated 180° after transferring the image to one surface of the card Ca, and the transfer section B2 transfers the image for the other surface to the other surface of the card Ca.

Moreover, this Embodiment shows the example of receiving (inputting) the printing data from the higher apparatus 201, but the present invention is not limited thereto. For example, in the case of a configuration where the printer 1 is capable of connecting to an external storage device such as USB and memory card, the printer 1 may acquire the printing data by reading the information stored in the external storage device. Further, in the case where the printer 1 constitutes a member of a local network, the information may be input from a personal computer connected to the local network other than the higher apparatus. Furthermore, instead of the printing data, the printer 1 may receive the image data from the higher apparatus 201. In this case, the image data received on the printer 1 side can be converted into the printing data.

Then, this Embodiment exemplifies the ink ribbon cassette 42, but the present invention is not limited thereto, and it is indisputable that the invention is applicable to types of ink ribbons without using the cassette.

The above-mentioned description is given with emphasis on the respect for preventing reduction in printing quality by the wrinkle occurring in the ink ribbon 41 in the image formation section B1, and the ink ribbon 41 and transfer film 46 are both in the shape of a film, and share the common respect that the wrinkle caused by the level difference occurs due to ink removal (in the case of the ink ribbon 41) and image removal (in the case of the transfer film 46). Therefore, the printer 1 of this Embodiment also has the advantage for preventing the wrinkle, which occurs in the rear end corner portion in the transport direction of the transfer region (region to which the printing image is transferred) of the transfer film 46 in the transfer section B2, from extending to the next region of the transfer film 46.

In addition, in the respect of action•effect, the film is slightly different from the above-mentioned case of the ink ribbon 41. As described above, in the image formation section B1, the wrinkle Wr1 (see FIG. 13) of the ink ribbon 41, which occurs in the rear end corner portion in the transport direction of the printing region Rt, is stopped by the sag that the ink is removed in the dummy printing region Rd. In contrast thereto, in the transfer section B2, a wrinkle (of the transfer film 46), which occurs in the rear end corner portion in the transport direction of the transfer region by the fact that the transfer region is transferred to the card Ca and is removed from the transfer film 46, is stopped by the dummy image (strictly, the ink of the dummy image absorbed and deposited in the reception layer of the transfer film 46) formed to stack on the transfer film 46. Further, in the ink ribbon 41, the wrinkle Wr2 (see FIG. 13) occurs in the rear end corner portion in the transport direction of the dummy printing region Rd by the fact that the ink of the dummy printing region Rd is removed. In contrast thereto, since the dummy image is formed only to stack on the transfer film 46 (because the dummy image is not removed from the transfer film 46 in transfer), the wrinkle caused by the level difference does not occur or is hard to occur in the rear end corner portion in the transport direction of the transfer film 46 where the dummy image is formed.

Accordingly, it is possible to include, in the scope of claims, "an image formation apparatus provided with an image formation section that includes a thermal head with a plurality of heating elements arranged and that transports an ink ribbon and a transfer medium at the same velocity to form a printing image on the transfer medium according to input printing information, a transfer section that includes a first rotating body and a second rotating body disposed opposite the first rotating body and that transports the transfer medium and a recording medium at the same velocity to transfer the printing image formed on the transfer medium in the image formation section to the recording medium, and a control section that controls the image formation section and the transfer section, where the control section controls the image formation section so as to form a dummy image at the back of the printing image formed on the transfer medium in a transport direction of the transfer medium, and controls the transfer section so as to transfer only the printing image formed on the transfer medium in the image formation section to the recording medium, and the dummy image is wider than the printing image on opposite sides in a width direction of the transfer medium crossing the transport direction of the transfer medium". In addition, in the above-mentioned Embodiment, the "first rotating body" is exemplified as the heat roller (heat rotating body) 33, and the "second rotating body" is exemplified as the platen roller 31.

The above-mentioned Embodiment (Embodiment 1) illustrates the aspect where the printing region Rt and dummy printing region Rd are provided inside a single ink panel, and as in Embodiment 2 described below, the dummy image may be formed in a position across a rearward ink panel of the printing image in the transport direction. In addition, in Embodiment 1 and Embodiment 2, the arrangement of the dummy printing region Rd only differs, and therefore, descriptions of common members, operation, effects and the like will be omitted.

Figure 19:
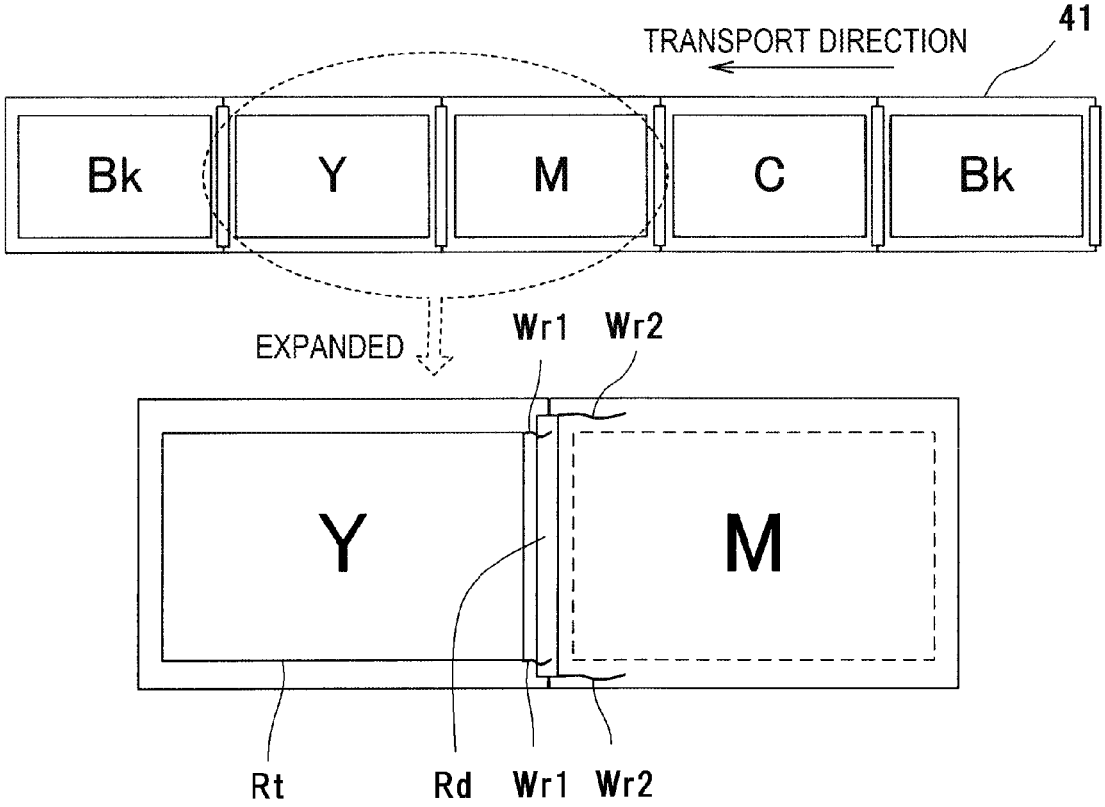
FIG. 19 is an explanatory view schematically showing wrinkles arising in the ink ribbon immediately after forming an image on the transfer film using the Y ink panel that is the first panel of the ink ribbon in a printer of Embodiment 2.
Figure 20A:
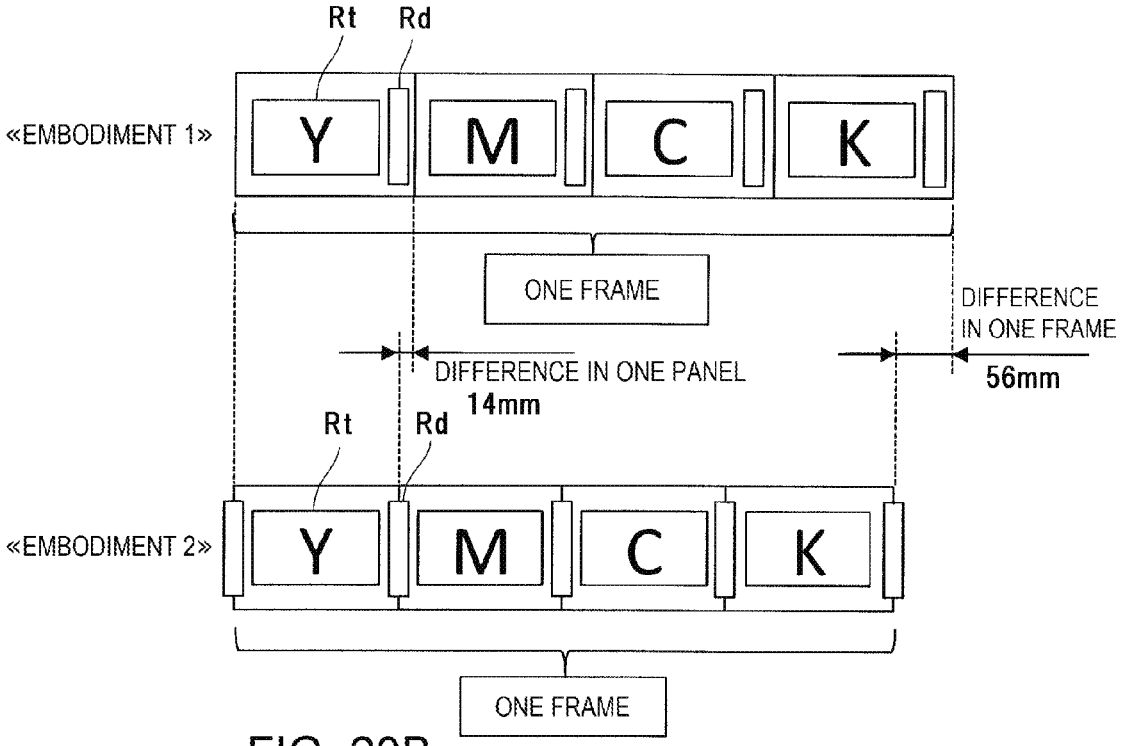
FIGS. 20A and 20B contain comparison explanatory views schematically showing lengths of ink panels of Embodiment 1 shown in FIG. 13 and Embodiment 2, where
Figure 20B:
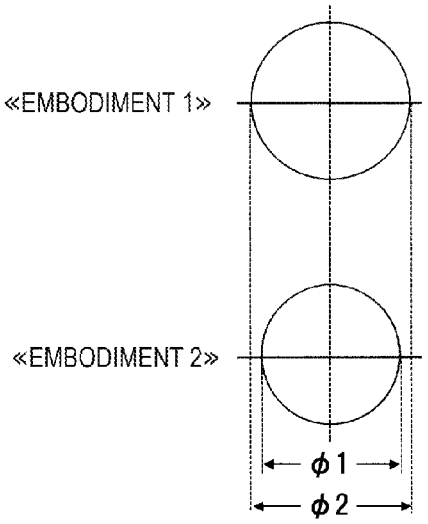
Figure 21A:
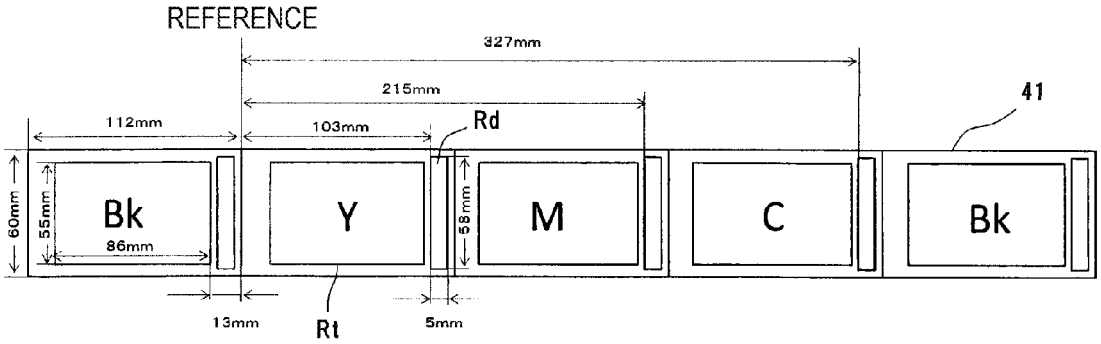
FIGS. 21A and 21B contain explanatory views showing dimensions of the ink ribbon, printing region and dummy printing region used in the printer of the Embodiment, where

In Embodiment 1, since the printing region Rt and dummy printing region Rd are provided inside a single ink panel, the length of the ink ribbon corresponding to one frame (ink panels of Y, M, C, Bk) is increased, there is the risk that the diameter of the ink ribbon is increased, and therefore, there is room for improvements. In Embodiment 2, the position across ink panels is set for the dummy printing region Rd (see FIGS. 19, 20A and 20B), it is possible to make the length of the ink ribbon corresponding to one frame shorter than in Embodiment 1, and it is possible to prevent the diameter of the ink ribbon from increasing. FIG. 20A shows a difference in the length corresponding to one frame of ink panels between Embodiment 1 and Embodiment 2, and FIG. 20B shows a difference in the diameter of a new ink ribbon, wound around the supply spool 43 (see FIG. 2), between Embodiment 1 and Embodiment 2 ($\Phi 1 < \Phi 2$). In other words, the ink ribbon 41 shown in Embodiments 1 and 2 has ink panels corresponding to 500 frames, the difference in the length of one ink panel between Embodiment 1 and Embodiment 2 (horizontal dimension 112 mm of the ink panel of Embodiment 1—horizontal dimension 98 mm of the ink panel of Embodiment 2) is (=) 14 mm (see FIGS. 21A and 21B, in addition, details of ink panels of Embodiments 1 and 2 will be described later), the difference in the length of one frame is 4 times the difference and is 56 mm, and the difference in the length of the entire ink ribbon is 2000 times the difference and is 28000 mm (28 m).

Figure 21B:
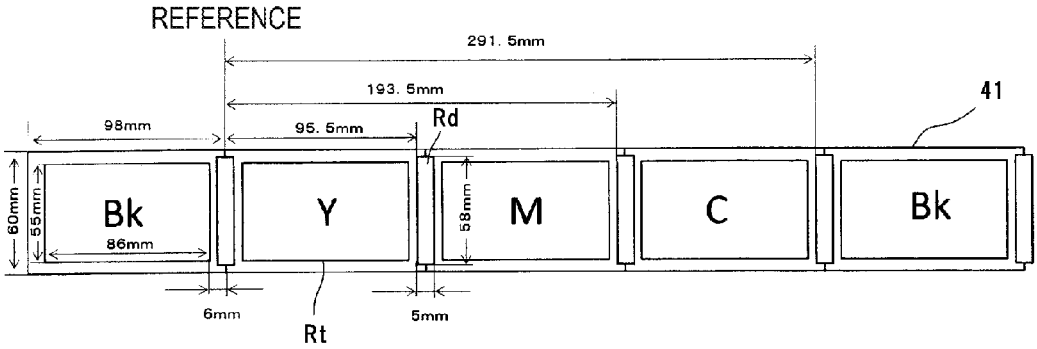

In Embodiment 2, as shown in FIG. 21B, as dimensions of each of ink panels Y, M, C, Bk of the ink ribbon 41, the horizontal dimension is set at 98 mm, and the vertical dimension is set at 60 mm. As dimensions (maximum dimensions subjected to printing) of the printing region Rt of each ink panel, the horizontal dimension is set at 86 mm, and the vertical dimension is set at 55 mm. As dimensions of the dummy printing region Rd, the horizontal dimension is set at 5 mm, and the vertical dimension is set at 58 mm. The length from the rear end of the printing region Rt of each ink panel to the panel rear end is set at 6 mm, and the length from the front end of each ink panel to the dummy printing region Rd is set at 95.5 mm. The printing region Rt is disposed at the center of each ink panel, and there is the distance of 6 mm between the front end of each ink panel and the front end of the printing region Rt and between the rear end of the printing region Rt and the panel rear end. The dummy printing region Rd is formed at the center of the position across ink panels. Therefore, the dummy printing region Rd is formed across adjacent ink panels each by 2.5 mm, and exhibits a symmetrical shape with respect to the boundary of adjacent ink panels. Further, as in Embodiment 1, since vertical dimensions of the printing region Rt and dummy printing region Rd are 55 mm and 58 mm, respectively, the vertical dimension of the dummy printing region Rd is longer (wider) than the vertical dimension of the printing region Rt on the opposite sides in the vertical direction (width direction crossing the transport direction of the ink ribbon 41) each by 1.5 mm. In addition, used were the transfer film 46 with the length in the width direction crossing the transport direction of 60 mm, and the card Ca with the horizontal dimension of 85.6 mm and the vertical dimension of 54 mm.

In the printer 1 of Embodiment 2, as shown in FIGS. 20A to 21B in comparison with the reference example, by setting the dummy printing region Rd on the position across ink panels, it is possible to shorten the length of the ink ribbon corresponding to one frame, reduce the cost of the ink ribbon 41, prevent the diameter of the ink ribbon from increasing, miniaturize the ink ribbon cassette 42, and eventually miniaturize the entire printer 1. Further, in addition thereto, as compared with Embodiment 1, the length used in one frame of the transfer film 46 is also shortened, and it is also possible to reduce running costs of the transfer film 46.

Figure 22A:
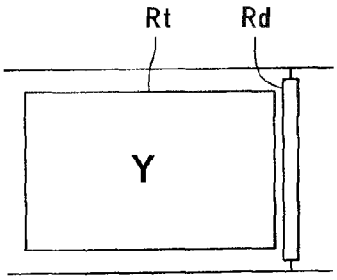
FIGS. 22A to 22F contain explanatory views to schematically explain Modifications of the printing region and dummy printing region, where
Figure 22B:
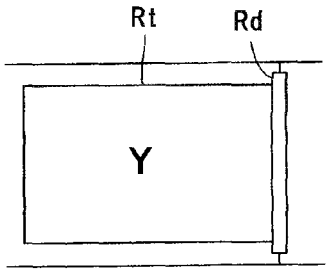
Figure 22C:
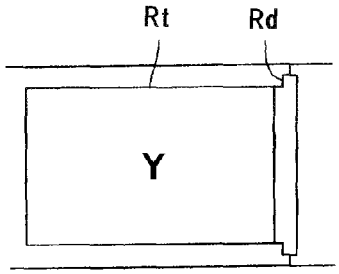
Figure 22D:
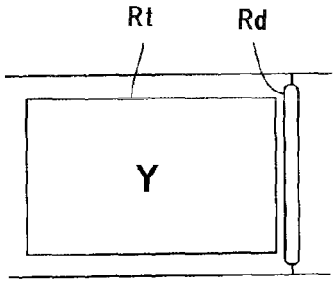
Figure 22E:
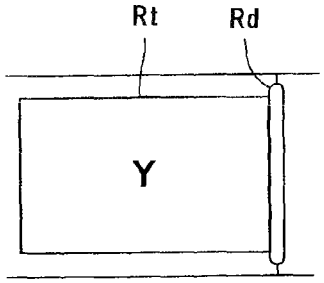
Figure 22F:
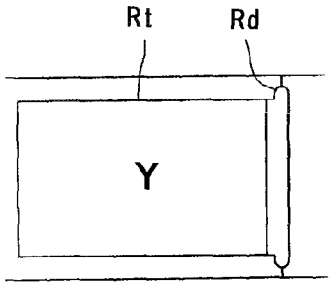

Further, Embodiment 2 shows the example where the printing region Rt and the dummy printing region Rd are separated and the dummy printing region Rd is in the shape of a rectangle (see FIG. 22A), but the present invention is not limited thereto, and allows various modifications thereof. For example, the printing region Rt and the dummy printing region Rd may be continued (see FIGS. 22B, 22C, 22E, and 22F), or each of the width-direction opposite end portions of the dummy printing region Rd may be in the shape of an arc (see FIGS. 22D to 22F). Furthermore, this Embodiment shows the example where the shape of the dummy printing region Rd is a symmetrical shape with respect to the boundary of adjacent ink panels (see FIG. 22A), but the present invention is not limited thereto, and the shape may be an asymmetrical shape with respect to the boundary of adjacent ink panels. In addition, in the case of continuously forming the printing region Rt and the dummy printing region Rd, one printing data may be newly generated to integrate the printing image and the dummy image formed on the transfer film 46. Such generation of new printing data may be performed on the higher apparatus 201 side, or may be performed on the printer 1 (control section 100) side.

In addition, this application claims priority from Japanese Patent Application No. 2015-071794 and Japanese Patent Application No. 2015-071795 incorporated herein by reference.

The invention claimed is:

1. An image formation apparatus for forming an image on a medium using an ink ribbon, comprising:

an image formation section, including a thermal head with a plurality of heating elements arranged, adapted to transport the ink ribbon and the medium at the same velocity to form an image on the medium; and a control section adapted to control the image formation section, wherein the control section controls the image formation section so as to form a printing image on the medium according to input printing information, and operate the heating elements on the ink ribbon to form a dummy image at the back of the printing image in a transport direction of the medium, and the dummy image is wider than the printing image on opposite sides in a width direction of the medium crossing the transport direction of the medium.

2. The image formation apparatus according to claim 1, wherein the control section controls the image formation section so as to form the printing image and the dummy image by a series of operation.

3. The image formation apparatus according to claim 1, wherein the control section controls the image formation section so that gradation values of pixels inside a region of the dummy image are the same.

4. The image formation apparatus according to claim 1, wherein the ink ribbon includes panels of a plurality of colors of dye ink panel and pigment ink panel, and the control section controls the image formation section so as to form the dummy image by operating the heating elements on at least the pigment ink panel among ink panels.

5. The image formation apparatus according to claim 1, wherein the ink ribbon is formed by repeating ink panels of a plurality of colors and a Bk (Black) ink panel as necessary in a face sequential manner, and the control section controls the image formation section so as to form the printing image and the dummy image by operating the heating elements on each of the ink panels.

6. The image formation apparatus according to claim 1, wherein the medium is a film-shaped intermediate transfer medium, and the apparatus further comprises a transfer section adapted to transfer the printing image formed on the intermediate transfer medium to a printing medium.

7. The image formation apparatus according to claim 1, wherein the medium is a card-shaped recording medium, the image formation section further includes a platen roller disposed opposite the thermal head, a circumferential length of the platen roller is longer than a length of the recording medium, and the platen roller includes a region that receives ink of the ink ribbon in forming the dummy image in a part of a circumferential surface thereof.

8. The image formation apparatus according to claim 1, wherein the ink ribbon is comprised of ink panels of a plurality of colors, and the control section controls the image formation section so as to form the dummy image in a position across a rearward ink panel of the printing image in the transport direction of the medium.

9. The image formation apparatus according to claim 8, wherein the control section controls the image formation section so as to form the dummy image symmetrically with respect to a boundary of adjacent ink panels.

* * * * *